US011725855B2

(12) United States Patent
Song et al.

(10) Patent No.: US 11,725,855 B2
(45) **Date of Patent: *Aug. 15, 2023**

(54) AIR CONDITIONING APPARATUS

(71) Applicant: LG ELECTRONICS INC., Seoul (KR)

(72) Inventors: Chiwoo Song, Seoul (KR); Yongcheol Sa, Seoul (KR); Kakjoong Kim, Seoul (KR); Ilyoong Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 294 days.

This patent is subject to a terminal disclaimer.

(21) Appl. No.: 17/088,773

(22) Filed: Nov. 4, 2020

(65) Prior Publication Data

US 2021/0199350 A1 Jul. 1, 2021

(30) Foreign Application Priority Data

Dec. 30, 2019 (KR) ..... 10-2019-0178470

(51) Int. Cl.
*F25B 13/00* (2006.01)
*F24F 3/06* (2006.01)
*F25B 25/00* (2006.01)

(52) U.S. Cl.
CPC ..... *F25B 13/00* (2013.01); *F24F 3/065* (2013.01); *F25B 25/005* (2013.01); *F25B 2313/0231* (2013.01); *F25B 2600/2501* (2013.01)

(58) Field of Classification Search
CPC ..... F25B 13/00; F25B 25/005; F25B 2313/0231; F25B 2600/2501; F24F 3/065
See application file for complete search history.

(56) References Cited

U.S. PATENT DOCUMENTS 7,377,119 B2 5/2008 Kim et al.
8,733,120 B2 5/2014 Morimoto
(Continued)

FOREIGN PATENT DOCUMENTS

CN 2750229 1/2006
CN 1734199 2/2006
(Continued)

OTHER PUBLICATIONS

Tamura, Oil Recovery Method for Air Conditioning System and Air Conditioning System, Sep. 9, 2004, JP2004251570A, Whole Document (Year: 2004).*
(Continued)

*Primary Examiner* — Larry L Furdge
(74) *Attorney, Agent, or Firm* — Ked & Associates

(57) ABSTRACT

Provided is an air conditioning apparatus. The air conditioning apparatus includes a heat exchanger in which the refrigerant and the water are heat-exchanged with each other, a high-pressure guide tube extending from a high-pressure gas tube of an outdoor unit so as to be connected to one side of the heat exchanger, a low-pressure guide tube extending from a low-pressure gas tube of the outdoor unit so as to be combined with the high-pressure guide tube, a liquid guide tube extending from a liquid tube of the outdoor unit so as to be connected to the other side of the heat exchanger, a bypass tube configured to connect a bypass branch point of the high-pressure gas tube to a bypass combination point of the liquid guide tube to bypass a high-pressure refrigerant existing in the high-pressure tube to the liquid guide tube, and a bypass valve installed in the bypass tube.

18 Claims, 8 Drawing Sheets

(56) References Cited

U.S. PATENT DOCUMENTS

| | | | |
|---|---|---|---|
| 9,032,747 | B2 | 5/2015 | Yamashita |
| 9,513,036 | B2 | 12/2016 | Motomura |
| 9,557,083 | B2 | 1/2017 | Azuma |
| 2006/0032254 | A1 | 2/2006 | Kim et al. |
| 2012/0006050 | A1 | 1/2012 | Takayama |
| 2012/0118005 | A1 | 5/2012 | Yamashita |
| 2012/0131948 | A1 | 5/2012 | Yamashita |
| 2012/0198873 | A1 | 8/2012 | Yamashita et al. |
| 2012/0198879 | A1 | 8/2012 | Motomura |
| 2012/0291472 | A1 | 11/2012 | Morimoto |
| 2014/0007607 | A1 | 1/2014 | Tamura et al. |
| 2014/0260387 | A1 | 9/2014 | Takenaka |
| 2015/0176864 | A1 | 6/2015 | Yamashita et al. |
| 2016/0209085 | A1 | 7/2016 | Kim et al. |
| 2016/0238290 | A1 | 8/2016 | Bae et al. |
| 2017/0108250 | A1 | 4/2017 | Song et al. |
| 2017/0205122 | A1 | 7/2017 | Kim et al. |
| 2018/0259218 | A1 | 9/2018 | Song |
| 2018/0347868 | A1 | 12/2018 | Okano et al. |
| 2018/0361828 | A1 | 12/2018 | Kato et al. |
| 2021/0199349 | A1 | 7/2021 | Lee |
| 2021/0199350 | A1 | 7/2021 | Song |
| 2021/0231317 | A1 | 7/2021 | Kim |

FOREIGN PATENT DOCUMENTS

| | | | | |
|---|---|---|---|---|
| CN | 106595105 | | | 4/2017 |
| CN | 106996653 | | | 8/2017 |
| CN | 108369042 | | | 8/2018 |
| EP | 1 628 086 | | | 2/2006 |
| EP | 1 635 129 | | | 3/2006 |
| EP | 2 402 687 | | | 1/2012 |
| EP | 2 508 819 | | | 10/2012 |
| EP | 3 205 954 | | | 8/2017 |
| JP | 2004251570 | A | * | 9/2004 |
| JP | 2013-170718 | | | 9/2013 |
| JP | 2017101854 | A | * | 6/2017 |
| KR | 10-2015-0034027 | | | 4/2015 |
| KR | 10-2016-0091298 | | | 8/2016 |
| WO | WO 2011/052042 | | | 5/2011 |
| WO | WO 2016/194145 | | | 12/2016 |
| WO | WO 2019/064566 | | | 4/2019 |
| WO | WO 2020/197052 | | | 10/2020 |
| WO | WO 2021/157820 | | | 8/2021 |

OTHER PUBLICATIONS

Ito et al., Air Conditioning System, Jun. 8, 2017, JP2017101854A, Whole Document (Year: 2017).*

International Search Report issued in Application No. PCT/KR2020/015132 dated Jan. 29, 2021.

European Search Report issued in Application No. 20211005.2 dated May 11, 2021.

Chinese Office Action dated Apr. 22, 2023 issued in Application No. 202080091544.7.

* cited by examiner

AIR CONDITIONING APPARATUS

CROSS-REFERENCE TO RELATED APPLICATIONS

The present application claims priority under 35 U.S.C. 119 and 35 U.S.C. 365 to Korean Patent Application No. 10-2019-0178470 (filed on Dec. 30, 2019), which is hereby incorporated by reference in its entirety.

BACKGROUND

The present disclosure relates to an air conditioning apparatus.

Air conditioning apparatuses are apparatuses that maintain air in a predetermined space to the most proper state according to use and purpose thereof. In general, such an air conditioning apparatus includes a compressor, a condenser, an expansion device, and evaporator. Thus, the air conditioning apparatus has a refrigerant cycle in which compression, condensation, expansion, and evaporation processes of a refrigerant are performed to cool or heat a predetermined space.

The predetermined space may be variously provided according to a place at which the air conditioning apparatus is used. For example, the predetermined space may be a home or office space.

When the air conditioning apparatus performs a cooling operation, an outdoor heat exchanger provided in an outdoor unit may serve as a condenser, and an indoor heat exchanger provided in an indoor unit may serve as an evaporator. On the other hand, when the air conditioning apparatus performs a heating operation, the indoor heat exchanger may serve as the condenser, and the outdoor heat exchanger may serve as the evaporator.

In recent years, according to environmental regulations, there is a tendency to limit the type of refrigerant used in the air conditioning apparatus and to reduce an amount of refrigerant to be used.

To reduce an amount of used refrigerant, a technique for performing cooling or heating by performing heat-exchange between a refrigerant and a predetermined fluid has been proposed. For example, the predetermined fluid may include water.

An air conditioning apparatus in which cooling or heating is performed through heat-exchange between a refrigerant and water is disclosed in US Patent No. 2015-0176864 (Published Date: Jun. 25, 2015) that is a prior art document.

The air conditioning apparatus disclosed in the prior are document includes a plurality of heat exchangers in which a refrigerant and water are heat-exchanged with each other and two valve devices connected to a refrigerant passage so that each of the heat exchangers operates as an evaporator or a condenser. That is, in the air conditioning apparatus according to the related art, an operation mode of the heat exchanger is determined through control of the valve device.

Also, the air conditioning apparatus according to the related art further includes three tubes connecting an outdoor unit to the heat exchange device. The three tubes include a high-pressure gas tube through which a high-pressure gas refrigerant flows, a low-pressure gas tube through which a low-pressure gas refrigerant flows, and a liquid tube through which a liquid refrigerant flows.

When a cooling operation is performed in the above-described three tube structure, the refrigerant condensed in the outdoor unit may flow into the liquid tube and be evaporated in the heat exchanger, and the evaporated refrigerant flows through the low-pressure gas tube so as to be introduced into the outdoor unit.

However, if a temperature of the refrigerant evaporated in the heat exchanger during this process is very low (e.g., when a temperature of the refrigerant is lowered to about 0 degree or less), water flowing through the heat exchanger is frozen, which may cause a problem that the heat exchanger is frozen to burst. When the heat exchanger is frozen to burst, the water and the refrigerant may be mixed due to internal leakage, and as a result, a major limitation in a system may occur.

(Patent Document 1) Publication number (Published Date): US 2015-0176864 (Jun. 25, 2015).

SUMMARY

Embodiments provide an air conditioning apparatus that is capable of preventing a heat exchanger, in which a refrigerant and water are heat-exchanged with each other, from being frozen to burst during a cooling operation of the indoor unit.

Embodiments also provide an air conditioning apparatus that is capable of preventing a heat exchanger from being frozen to burst even when an indoor unit performs a simultaneous operation in which a cooling operation and a heating operation are performed at the same time.

Embodiments also provide an air conditioning apparatus that is capable of determining a heat exchanger, which may be frozen to burst, of a plurality of heat exchangers to supply a high-temperature refrigerant toward only the corresponding heat exchanger.

Embodiments also provide an air conditioning apparatus, in which an opening degree of a bypass valve is adjusted according to an operation mode of an indoor unit to prevent a heat exchanger from being frozen to burst while maintaining performance of the heat exchanger.

In one embodiment, an air conditioning apparatus includes: an outdoor unit which includes a compressor and an outdoor heat exchanger and through which a refrigerant is circulated; an indoor unit through which water is circulated; a heat exchanger in which the refrigerant and the water are heat-exchanged with each other; a high-pressure guide tube extending from a high-pressure gas tube of the outdoor unit so as to be connected to one side of the heat exchanger; a low-pressure guide tube extending from a low-pressure gas tube of the outdoor unit so as to be combined with the high-pressure guide tube; and a liquid guide tube extending from a liquid tube of the outdoor unit so as to be connected to the other side of the heat exchanger.

The air conditioning apparatus includes: a bypass tube configured to connect a bypass branch point of the high-pressure gas tube to a bypass combination point of the liquid guide tube to bypass a high-pressure refrigerant existing in the high-pressure tube to the liquid guide tube; and a bypass valve installed in the bypass tube. Therefore, a high-temperature high-pressure refrigerant flowing to the high-pressure gas tube by the bypass tube may be bypassed to the heat exchanger to prevent the heat exchanger from being frozen to burst.

When the indoor unit performs a cooling operation, the bypass valve may be opened to bypass the high-pressure refrigerant of the high-pressure gas tube to the liquid guide tube. When the indoor unit performs a heating operation, the bypass valve may be closed to bypass the high-pressure refrigerant of the high-pressure gas tube to the liquid guide tube.

The heat exchanger is provided in plurality, and when some of the plurality of heat exchangers function as condensers configured to condense the refrigerant, and remaining heat exchangers function as evaporators configured to evaporate the refrigerant, the bypass valve may be opened to bypass the high-pressure refrigerant of the high-pressure gas tube to the heat exchangers that function as the evaporators.

That is, when the indoor unit performs the simultaneous operation, the bypass valve may be opened so that the high-pressure refrigerant of the high-pressure gas tube is introduced into the heat exchanger, which serves as an evaporator, to prevent the heat exchanger from being frozen to burst.

The air conditioning apparatus may further include a high-pressure valve installed in the high-pressure guide tube, the high-pressure valve being configured to be opened and closed, a low-pressure valve installed in the low-pressure guide tube, the low-pressure valve being configured to be opened and closed, and a flow valve installed in the liquid guide tube to control a flow rate of the refrigerant.

The bypass combination point may be defined at a point between the heat exchanger and the flow valve.

The air conditioning apparatus may further include a refrigerant tube having one end defining a refrigerant branch point, at which the high-pressure guide tube and the low-pressure guide tube are combined with each other, and the other end connected to a refrigerant passage of the heat exchanger.

The air conditioning apparatus may further include: a gas refrigerant sensor installed in the refrigerant tube to detect a temperature of the refrigerant; a liquid refrigerant sensor installed in the liquid guide tube to detect a temperature of the refrigerant; and a controller configured to adjust an opening degree of the bypass valve based on the temperatures detected by the gas refrigerant sensor and the liquid refrigerant sensor.

The controller may be configured to determine whether the temperature detected by the gas refrigerant sensor or the liquid refrigerant sensor is equal to or less than a first reference temperature, and when the temperature detected by the gas refrigerant sensor or the liquid refrigerant sensor is equal to or less than the first reference temperature, the bypass valve may be opened.

The temperatures of the refrigerant, which are detected by the gas refrigerant sensor and liquid refrigerant sensor, may be detected again, and the controller may be configured to determine whether each of the temperatures detected by the gas refrigerant sensor and liquid refrigerant sensor is equal to or greater than a second reference temperature.

When each of the temperatures of the refrigerant, which are detected by the gas refrigerant sensor and the liquid refrigerant sensor is less than the second reference temperature, the controller may be configured to control the bypass valve so that the bypass valve increases in opening degree.

When each of the temperatures detected by the gas refrigerant sensor and the liquid refrigerant sensor is equal to or greater than the second reference temperature, the controller may be configured to control the bypass valve so that the bypass valve decreases in opening degree.

When each of the temperatures detected by the gas refrigerant sensor and the liquid refrigerant sensor is equal to or greater than the second reference temperature, the controller may be configured to determine whether the opening degree of the bypass valve is equal to or greater than a reference opening degree, and when the opening degree of the bypass valve is equal to or greater than the reference opening degree, the bypass valve may decrease in opening degree.

In another embodiment, an air conditioning apparatus includes: an outdoor unit which includes a compressor and an outdoor heat exchanger and through which a refrigerant is circulated; an indoor unit through which water is circulated; a first heat exchanger and a second heat exchanger, in which the refrigerant and the water are heat-exchanged with each other; a first high-pressure guide tube extending from a high-pressure gas tube of the outdoor unit so as to be connected to one side of the first heat exchanger; and a second high-pressure guide tube extending from the high-pressure gas tube of the outdoor unit so as to be connected to one side of the second heat exchanger.

The air conditioning apparatus further includes: a first low-pressure guide tube extending from a low-pressure gas tube of the outdoor unit so as to be combined with the first high-pressure guide tube; a second low-pressure guide tube extending from the low-pressure gas tube of the outdoor unit so as to be combined with the second high-pressure guide tube; a first liquid guide tube extending from a liquid tube of the outdoor unit so as to be connected to the other side of the first heat exchanger; and a second liquid guide tube extending from the liquid tube of the outdoor unit so as to be connected to the other side of the second heat exchanger.

The air conditioning apparatus includes: a bypass tube configured to bypass a high-pressure refrigerant of the high-pressure gas tube to the first liquid guide tube or the second liquid guide tube; and a bypass valve installed in the bypass tube, wherein the bypass tube includes: a common tube branched from a first bypass branch portion of the high-pressure gas tube; a first bypass tube branched from a second bypass branch portion of the common tube, the first bypass tube being connected to a first bypass combination point of the first liquid guide tube; and a second bypass tube branched from the second bypass branch portion of the common tube, the second bypass tube being connected to a second bypass combination point of the second liquid guide tube.

Therefore, a high-temperature high-pressure refrigerant flowing to the high-pressure gas tube by the bypass tube may be bypassed to the first heat exchanger or the second heat exchanger to prevent the heat exchanger from being frozen to burst.

The bypass valve may include: a first bypass valve installed in the first bypass tube; and a second bypass valve installed in the second bypass tube.

When the indoor unit performs a cooling operation, at least one or more of the first bypass valve and the second bypass valve may be opened to bypass the high-pressure refrigerant of the high-pressure gas tube to at least one or more of the first liquid guide tube and the second liquid guide tube. Thus, the high-pressure refrigerant of the high-pressure gas tube may be selectively introduced into one or more of the first heat exchanger and the second heat exchanger.

The air conditioning apparatus may further include: a first high-pressure valve and a second high-pressure valve, which are installed in the first high-pressure guide tube and the second high-pressure guide tube, respectively; a first low-pressure valve and a second low-pressure valve, which are installed in the first low-pressure guide tube and the second low-pressure guide tube, respectively; and a first flow valve and a second flow valve, which are installed in the first liquid guide tube and the second liquid guide tube, respectively.

The first bypass combination point may be defined at a point between the first heat exchanger and a first flow valve, and the second bypass combination point may be defined at a point between the second heat exchanger and a second flow valve.

The air conditioning apparatus may further include: a first refrigerant tube having one end defining a first refrigerant branch point, at which the first high-pressure guide tube and the first low-pressure guide tube are combined with each other, and the other end connected to a refrigerant passage of the first heat exchanger; and a second refrigerant tube having one end defining a second refrigerant branch point, at which the second high-pressure guide tube and the second low-pressure guide tube are combined with each other, and the other end connected to a refrigerant passage of the second heat exchanger.

The air conditioning apparatus may further include: a gas refrigerant sensor installed in each of the first refrigerant tube and the second refrigerant tube to detect a temperature of the refrigerant; a liquid refrigerant sensor installed in each of the first liquid guide tube and the second liquid guide tube to detect a temperature of the refrigerant; and a controller configured to adjust an opening degree of the bypass valve based on the temperatures detected by the gas refrigerant sensor and the liquid refrigerant sensor.

The details of one or more embodiments are set forth in the accompanying drawings and the description below. Other features will be apparent from the description and drawings, and from the claims.

DETAILED DESCRIPTION OF THE EMBODIMENTS

Figure 1:
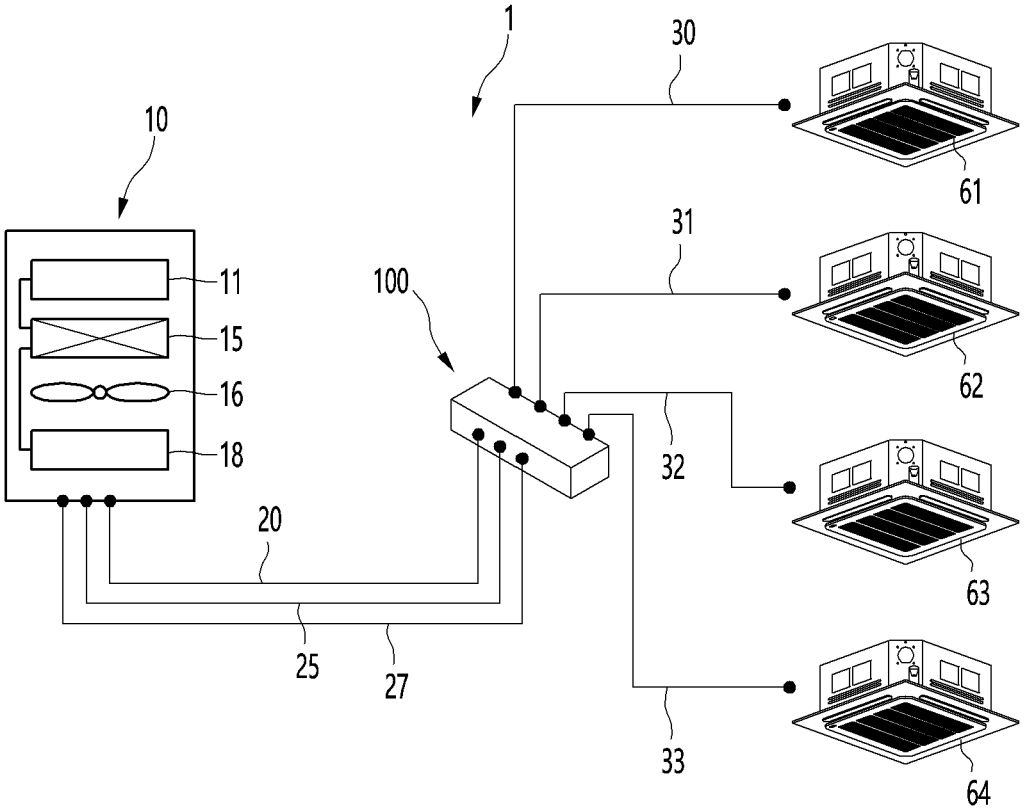
FIG. 1 is a schematic view of an air conditioning apparatus according to an embodiment.

Hereinafter, some embodiments of the present invention will be described in detail with reference to the accompanying drawings. It is noted that the same or similar components in the drawings are designated by the same reference numerals as far as possible even if they are shown in different drawings. In the following description of the present invention, a detailed description of known functions and configurations incorporated herein will be omitted to avoid making the subject matter of the present invention unclear.

In the description of the elements of the present invention, the terms first, second, A, B, (a), and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
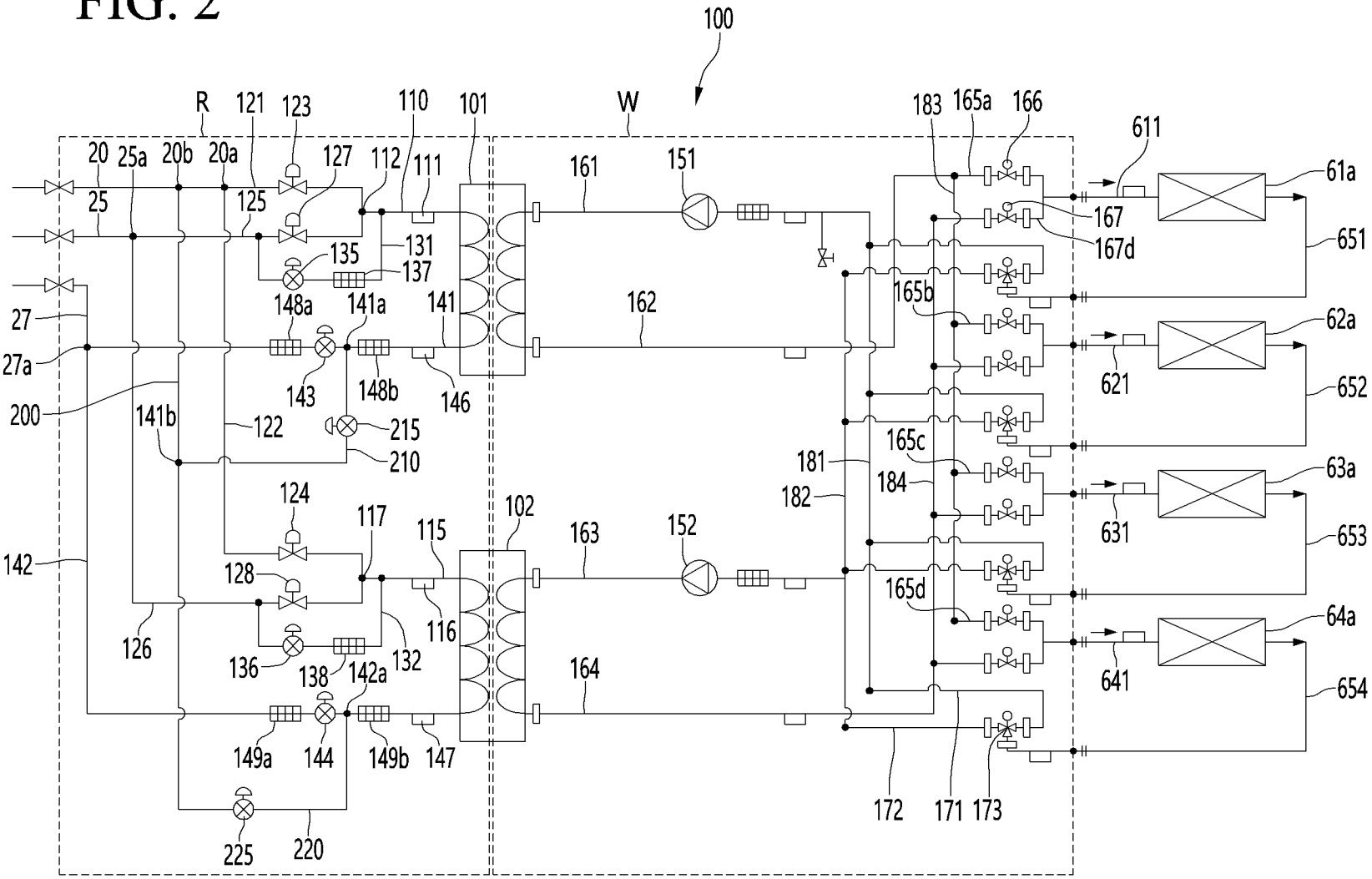
FIG. 2 is a cycle diagram illustrating constituents of an outdoor unit according to an embodiment.

FIG. 1 is a schematic view of an air conditioning apparatus according to an embodiment, and FIG. 2 is a cycle diagram illustrating constituents of an outdoor unit according to an embodiment.

Referring to FIGS. 1 and 2, an air conditioning apparatus 1 according to an embodiment is connected to an outdoor unit 10, an indoor unit 50, and a heat exchange device 100 connected to the outdoor unit 10 and the indoor unit 50.

The outdoor unit 10 and the heat exchange device 100 may be fluidly connected by a first fluid. For example, the first fluid may include a refrigerant.

The refrigerant may flow through a refrigerant-side flow path of a heat exchanger, which is provided in the heat exchange device 100, and the outdoor unit 10.

The outdoor unit 10 may include a compressor 11 and an outdoor heat exchanger 15.

An outdoor fan 16 may be provided at one side of the outdoor heat exchanger 15 to blow external air toward the outdoor heat exchanger 15 so that heat exchange between the external air and the refrigerant of the outdoor heat exchanger 15 is performed.

The outdoor unit 10 may further include a main expansion valve 18 (EEV).

The air conditioning apparatus 1 may further include three tubes 20, 25, and 27 connecting the outdoor unit 10 to the heat exchange device 100.

The three tubes 20, 25, and 27 include a high-pressure gas tube 20 through which a high-pressure gas refrigerant flows, a low-pressure gas tube 25 through which a low-pressure gas refrigerant flows, and a liquid tube 27 through which a liquid refrigerant flows.

That is, the outdoor unit 10 and the heat exchange device 100 may have a "three tube connection structure", and the refrigerant may circulate through the outdoor unit 10 and the heat exchange device 100 by the three tubes 20, 25, and 27.

The heat exchange device 100 and the indoor unit 50 may be fluidly connected by a second fluid. For example, the second fluid may include water.

The water may flow through a water passage of the heat exchanger, which is provided in the heat exchange device 100, and the indoor unit 50.

The heat exchange device 100 may include a plurality of heat exchangers 101 and 102. Each of the heat exchangers 140 and 141 may include, for example, a plate heat exchanger.

The indoor unit 50 may include a plurality of indoor units 61, 62, 62, and 63.

In this embodiment, the number of plurality of indoor units 61, 62, 63, and 64 is not limited. In FIG. 1, for example, four indoor units 61, 62, 63, and 64 are connected to the heat exchange device 100.

The plurality of indoor units 61, 62, 63, and 64 may include a first indoor unit 61, a second indoor unit 62, a third indoor unit 63, and a second indoor unit 64.

The air conditioning apparatus 1 may further include tubes 30, 31, 33, and 33 connecting the heat exchange device 100 to the indoor unit 50.

The tubes 30, 31, 32, and 33 may include first to fourth indoor unit connection tubes 30, 31, 32, and 33, which respectively connect the heat exchange device 100 to the Heat Exchanger units 61, 62, 63 and 64.

The water may circulate through the heat exchange device 100 and the indoor unit 50 via the indoor unit connection tubes 30, 31, 32, and 33. Here, the number of indoor units increases, the number of tubes connecting the heat exchange device 100*a* to the indoor units may also increase.

According to the above-described configuration, the refrigerant circulating through the outdoor unit 10 and the heat exchange device 100 and the water circulating through the heat exchange device 100 and the indoor unit 50 are heat-exchanged with each other through the heat exchangers 101 and 102 provided in the heat exchange device 100.

The water cooled or heated through the heat-exchange may be heat-exchanged with indoor heat exchangers 61*a*, 62*a*, 63*a*, and 64*a* provided in the indoor unit 50 to perform cooling or heating in the indoor space.

In this embodiment, two or more indoor units may be connected to one heat exchanger. Alternatively, one indoor unit may be connected to one heat exchanger. In this case, the plurality of heat exchangers may be provided in the same number as the number of the plurality of indoor units.

Hereinafter, the heat exchange device 100 will be described in detail with reference to the drawings.

The heat exchange device 100 may include first and second heat exchangers 101 and 102 which are fluidly connected to the indoor units 61, 62, 63, and 64, respectively.

The first heat exchanger 101 and the second heat exchanger 102 may have the same structure.

Each of the heat exchangers 101 and 102 may include, for example, a plate heat exchanger and may be configured so that the water passage and the refrigerant passage are alternately stacked.

Each of the heat exchangers 101 and 102 may include the refrigerant passage and the water passage.

Each of the refrigerant passages may be fluidly connected to the outdoor unit 10, and the refrigerant discharged from the outdoor unit 10 may be introduced into the refrigerant passage, or the refrigerant passing through the refrigerant passage may be introduced into the outdoor unit 10.

Each of the water passages may be connected to each of the indoor units 61, 62, 63, and 64, the water discharged from each of the indoor units 61, 62, 63, and 64 may be introduced into the water passage, and the water passing through the water passage may be introduced into each of the indoor units 61, 62, 63, and 64.

The heat exchange device 100 may include a switching unit R for adjusting a flow direction and flow rate of the refrigerant introduced into and discharged from the first heat exchanger 101 and the second heat exchanger 102.

In detail, the switching unit R includes refrigerant tubes 110 and 115 coupled to one sides of the heat exchangers 101 and 102 and liquid guide tubes 141 and 142 coupled to the other sides of the heat exchanger 101 and 102.

The refrigerant tubes 110 and 115 and the liquid guide tubes 141 and 142 may be connected to a refrigerant passage provided in each of the heat exchangers 101 and 102 so as to be heat-exchanged with the water.

The refrigerant tubes 110 and 115 and the liquid guide tubes 141 and 142 may guide the refrigerant to pass through the heat exchangers 101 and 102.

In detail, the refrigerant tubes 110 and 115 may include a first refrigerant tube 110 coupled to one side of the first heat exchanger 101 and a second refrigerant tube 115 coupled to one side of the second heat exchanger 102.

The liquid guide tubes 141 and 142 may include a first liquid guide tube 141 coupled to the other side of the first heat exchanger 101 and a second liquid guide tube 142 coupled to the other side of the second heat exchanger 102.

For example, the refrigerant may be circulated through the first heat exchanger 101 by the first refrigerant tube 110 and the first liquid guide tube 141. Also, the refrigerant may be circulated through the second heat exchanger 102 by the second refrigerant tube 115 and the second liquid guide tube 142.

The liquid guide tubes 141 and 142 may be connected to the liquid tube 27.

In detail, the liquid tube 27 may define a liquid tube branch point 27*a* branching into the first liquid guide tube 141 and the second liquid guide tube 142.

That is, the first liquid guide tube 141 may extend from the liquid tube branch point 27*a* to the first heat exchanger 101, and the second liquid guide tube 142 may extend from the liquid tube branch point 27*a* to the second heat exchanger 102.

The air conditioning apparatus 1 may further include gas refrigerant sensors 111 and 116 installed in the refrigerant tubes 110 and 115 and liquid refrigerant sensors 146 and 147 installed in the liquid guide tubes 141 and 142.

The gas refrigerant sensors 111 and 116 and the liquid refrigerant sensors 146 and 147 may be referred to as "refrigerant sensors".

Also, the refrigerant sensors may detect a state of the refrigerant flowing through the refrigerant tubes 110 and 115 and the liquid guide tubes 141 and 142. For example, the refrigerant sensors may detect a temperature and pressure of the refrigerant.

The gas refrigerant sensors 111 and 116 may include a first gas refrigerant sensor 111 installed in the first refrigerant tube 110 and a second gas refrigerant sensor 116 installed in the second refrigerant tube 115.

The liquid refrigerant sensors 146 and 147 may include a first liquid refrigerant sensor 146 installed in the first liquid guide tube 141 and a second liquid refrigerant sensor 147 installed in the second liquid guide tube 142.

The air conditioning apparatus 1 may further include flow valves 143 and 144 installed in the liquid guide tubes 141 and 142.

Each of the flow valves 143 and 144 may adjust a flow rate of the refrigerant by adjusting an opening degree thereof. Each of the flow valves 143 and 144 may include an electronic expansion valve (EEV). Also, each of the flow valves 143 and 144 may be adjusted in opening degree to adjust a pressure of the refrigerant passing therethrough.

The electronic expansion valve may reduce a pressure of the refrigerant passing through the expansion valves 143 and 144 by adjusting the opening degree. For example, when the electronic expansion valves 143 and 144 are fully opened (full-open state), the refrigerant may pass without decompression, and when the opening degree of each of the expansion valves 143 and 144 is reduced, the refrigerant may be depressurized. A degree of decompression of the refrigerant may increase as the degree of opening decreases.

The flow valves 143 and 144 may include a first flow valve 143 installed in the first liquid guide tube 141 and a second flow valve 144 installed in the second liquid guide tube 142.

The air conditioning apparatus 1 may further include strainers 148*a*, 148*b*, 149*a*, and 149*b* installed on both sides of the flow valves 143 and 144.

The strainers 148*a*, 148*b*, 149*a*, and 149*b* are devices for filtering wastes of the refrigerant flowing through the liquid guide tubes 141 and 142. For example, the strainers 148*a*, 148*b*, 149*a*, and 149*b* may be provided as a metal mesh.

The strainers 148*a*, 148*b*, 149*a*, and 149*b* may include a first strainer 148*a* and 148*b* installed on the first liquid guide tube 141 and second strainer 149*a* and 149*b* installed on the second liquid guide tube 142.

The first strainers 148*a* and 148*b* may include a strainer 148*a* installed at one side of the first flow valve 143 and a strainer 148*b* installed at the other side of the first flow valve 143. As a result, even if the flow direction of the refrigerant is switched, the wastes may be filtered.

Likewise, the second strainers 149*a* and 149*b* may include a strainer 149*a* installed at one side of the second flow valve 144 and a strainer 149*b* installed at the other side of the second flow valve 144.

The refrigerant tubes 110 and 115 may be connected to the high-pressure gas tube 20 and the low-pressure gas tube 25. Also, the liquid guide tubes 141 and 142 may be connected to the liquid tube 27.

In detail, the refrigerant tubes 110 and 115 may define refrigerant branch points 112 and 117 at one ends thereof, respectively. Also, the refrigerant branch points 112 and 117 may be connected so that the high-pressure gas tube 20 and the low-pressure gas tube 25 are combined with each other.

That is, one ends of the refrigerant tubes 110 and 115 have refrigerant branch points 112 and 117, and the other ends of the refrigerant tubes 110 and 115 may be coupled to the refrigerant passages of the heat exchangers 101 and 102.

The switching unit R may further include high-pressure guide tubes 121 and 122 extending from the high-pressure gas tube 20 to the refrigerant tubes 110 and 115.

That is, the high-pressure guide tubes 121 and 122 may connect the high-pressure gas tube 20 to the refrigerant tubes 110 and 115.

The high-pressure guide tubes 121 and 122 may be branched from the high-pressure branch point 20*a* of the high-pressure gas tube 20 to extend to the refrigerant tubes 110 and 115.

In detail, the high-pressure guide tubes 121 and 122 may include a first high-pressure guide tube 121 extending from the high-pressure branch point 20*a* to the first refrigerant tube 110 and a second refrigerant guide tube 122 extending from the second high-pressure branch point 20*a* to the second refrigerant tube 115.

The first high-pressure guide tube 121 may be connected to the first refrigerant branch point 112, and the second high-pressure guide tube 122 may be connected to the second refrigerant branch point 117.

That is, the first high-pressure guide tube 121 may extend from the high-pressure branch point 20*a* to the first refrigerant branch point 112, and the second high-pressure guide tube 122 may extend from the high-pressure branch point 20*a* to the second refrigerant branch point 117.

The air conditioning apparatus 1 may further include high-pressure valves 123 and 124 installed in the high-pressure guide tubes 121 and 122.

Each of the high-pressure valves 123 and 124 may restrict a flow of the refrigerant to each of the high-pressure guide tubes 121 and 122 through an opening and closing operation thereof.

The high-pressure valves 123 and 124 may include a first high-pressure valve 123 installed in the first high-pressure guide tube 121 and a second high-pressure valve 124 installed in the second high-pressure guide tube 122.

The first high-pressure valve 123 may be installed between the high-pressure branch point 20*a* and the first refrigerant branch point 112.

The second high-pressure valve 124 may be installed between the high-pressure branch point 20*a* and the second refrigerant branch point 117.

The first high-pressure valve 123 may control a flow of the refrigerant between the high-pressure gas tube 20 and the first refrigerant tube 110. Also, the second high-pressure valve 124 may control a flow of the refrigerant between the high-pressure gas tube 20 and the second refrigerant tube 115.

The switching unit R may further include low-pressure guide tubes 125 and 126 extending from the low-pressure tube 25 to the refrigerant tubes 110 and 115.

That is, the low-pressure guide tubes 125 and 126 may connect the low-pressure tube 25 to the refrigerant tubes 110 and 115.

The low-pressure guide tubes 125 and 126 may be branched from the low-pressure branch point 25*a* of the low-pressure gas tube 25 to extend to the refrigerant tubes 110 and 115.

In detail, the low-pressure guide tube 125 and 126 may include a first low-pressure guide tube 125 extending from the low-pressure branch point 25*a* to the first refrigerant tube 110 and a second low-pressure guide tube 126 extending from the low-pressure branch point 25*a* to the second low-pressure refrigerant tube 115.

The first low-pressure guide tube 125 may be connected to the first refrigerant branch point 112, and the second low-pressure guide tube 126 may be connected to the second refrigerant branch point 117.

That is, the first low-pressure guide tube 125 may extend from the low-pressure branch point 25*a* to the first refrigerant branch point 112, and the second low-pressure guide tube 126 may extend from the low-pressure branch point 25*a* to the second refrigerant branch point 117. Thus, the high-pressure guide tubes 121 and 122 and the low-pressure guide tubes 125 and 126 may be combined with each other at the refrigerant branch points 115 and 117.

The air conditioning apparatus 1 may further include low-pressure valves 127 and 128 installed in the low-pressure guide tubes 126 and 127.

Each of the low-pressure valves 127 and 128 may restrict a flow of the refrigerant to each of the low-pressure guide tubes 125 and 126 through an opening and closing operation thereof.

The low-pressure valves 127 and 128 may include a first low-pressure valve 127 installed in the first low-pressure guide tube 125 and a second low-pressure valve 128 installed in the second low-pressure guide tube 126.

The first low-pressure valve 127 may be installed between a point at which the first refrigerant branch point 112 and a first pressure equalization tube 131 to be described later are connected to each other.

The second low-pressure valve 128 may be installed between a point at which the second refrigerant branch point 117 and a second pressure equalization tube 132 to be described later are connected to each other.

The switching unit R may further include pressure equalization tubes 131 and 132 branching from the first refrigerant tube 110 to extend to the low-pressure guide tubes 125 and 126.

The pressure equalization tubes 131 and 132 may include a first pressure equalization tube 131 branched from one point of the first refrigerant tube 110 to extend to the first low-pressure guide tube 125 and a second pressure equalization tube 132 branching from one point of the second refrigerant tube 115 to extend to the second low-pressure guide tube 126.

Points at which the pressure equalization tubes 131 and 132 and the low-pressure guide tubes 125 and 126 are connected to each other may be disposed between the low-pressure branch point 25*a* and the low-pressure valves 127 and 128, respectively.

That is, the first pressure equalization tube 131 may be branched from the first refrigerant tube 110 to extend to the first low-pressure guide tube 125 disposed between the low-pressure branch point 25*a* and the first low-pressure valve 127.

Similarly, the second pressure equalization tube 132 may be branched from the second refrigerant tube 115 to extend to the second low-pressure guide tube 126 disposed between the low-pressure branch point 25*a* and the second low-pressure valve 128.

The air conditioning apparatus 1 may further include pressure equalization valves 135 and 136 and pressure equalization strainers 137 and 138, which are installed in the pressure equalization tubes 131 and 132.

The pressure equalization valves 135 and 136 may be adjusted in opening degree to bypass the refrigerant in the refrigerant tubes 110 and 115 to the low-pressure guide tubes 125 and 126.

Each of the pressure equalization valves 135 and 136 may include an electronic expansion valve (EEV).

The pressure equalization valves 135 and 136 may include a first pressure equalization valve 135 installed in the first pressure equalization tube 131 and a second pressure equalization valve 136 installed in the second pressure equalization tube 132.

The pressure equalization strainers 137 and 138 may include a first pressure equalization strainer 137 installed in the first pressure equalization tube 131 and a second pressure equalization strainer 138 installed in the second pressure equalization tube 132.

The pressure equalization strainers 137 and 138 may be disposed between the pressure equalization valves 135 and 136 and the refrigerant tubes 110 and 115. Thus, the wastes of the refrigerant flowing from the refrigerant tubes 110 and 115 to the pressure equalization valves 135 and 136 may be filtered, or foreign substances may be prevented from passing therethrough.

The pressure equalization tubes 131 and 132 and the pressure equalization valves 135 and 136 may be referred to as a "pressure equalization circuit".

The pressure equalization circuit may operate to reduce a pressure difference between the high-pressure refrigerant and the low-pressure refrigerant in the refrigerant tubes 110 and 115 when an operation mode of the heat exchangers 101 and 102 is switched.

Here, the operation mode of the heat exchangers 101 and 102 may include a condenser mode operating as the condenser and an evaporator mode operating as the evaporator.

For example, when the heat exchangers 101 and 102 switch the operation mode from the condenser to the evaporator, the high-pressure valves 123 and 124 may be closed, and the low-pressure valves 127 and 128 may be opened.

The adjustment of the opening degree of each of the pressure equalization valves 135 and 136 may be performed gradually as the time elapses. Thus, the opening degree of the high-pressure valves 123 and 124 and the low-pressure valve 127 may also be controlled.

The pressures of the refrigerant tubes 110 and 115 may be lowered by the refrigerant introduced into the pressure equalization tubes 131 and 132.

Thus, the pressure equalization valves 135 and 136 may be opened to reduce the pressure difference between the low-pressure guide tubes 125 and 126 and the refrigerant tubes 110 and 115 within a predetermined range, thereby realizing pressure equalization.

Also, the pressure equalization valves 135 and 136 may be closed again. Thus, the low-pressure refrigerant passing through the heat exchangers 101 and 102 may flow to the low-pressure guide tubes 125 and 126 without a large pressure difference.

As a result, since the heat exchangers 101 and 102 are stably switched to serve as the evaporator, noise generation and durability limitations caused by the above-described pressure difference may be solved.

The air conditioning apparatus 1 may further include bypass tubes 200, 210, and 220 connecting the high-pressure gas tube 20 to the low-pressure gas tube 25.

The bypass tube 200, 210, and 220 may bypass the high-pressure refrigerant flowing through the high-pressure gas tube 20 to the heat exchangers 101 and 102 to prevent the heat exchangers 101 and 102 from being frozen to burst.

For example, when the temperature of the refrigerant is very low in the process of the heat exchange between the water and the refrigerant (for example, when the temperature of the refrigerant is about 0 degree or less), the temperature of the water may be lowered below about 0 degree to cause freezing and bursting. When the heat exchangers 101 and 102 are frozen to burst, the water and the refrigerant may be mixed due to internal leakage, and as a result, a major limitation in the system may occur.

Thus, in this embodiment, to prevent the heat exchanger from being frozen to burst, when there is a risk of the freezing and bursting of the heat exchangers 101 and 120, the high-temperature high-pressure refrigerant may be injected into the heat exchangers 101 and 102 through the bypass tubes 200, 210 and 220.

In detail, the bypass tubes 200, 210, and 220 may include a common tube 200 branching from one point of the high-pressure gas tube 20, a second bypass tube 220 branched from the common tube 200 and connected to the first liquid guide tube 141, and a third bypass tube 230 branched from the common tube 200 and connected to the second liquid guide tube 142.

The common tube 200 may be branched from a first bypass branch point 20*b* of the high-pressure gas tube 20 to extend. The high-pressure refrigerant of the high-pressure gas tube 20 may flow through the common tube 200.

The second bypass tube 210 may be branched from a second bypass branch point 141*b* of the common tube 200 to extend to a first bypass combination point 141*a* of the first liquid guide tube 141.

The first bypass combination point 141*a* may be defined at a point between the first flow valve 143 and the first heat exchanger 101 in the first liquid guide tube 141.

Specifically, the first bypass combination point 141*a* may be defined at a point between the first flow valve 143 and the first strainer 148*b*.

Alternatively, the first bypass combination point 141*a* may be defined at a point between the first flow valve 143 and the first liquid refrigerant sensor 146.

The third bypass tube 220 may be branched from the second bypass branch point 141*b* of the common tube 200 and connected to the second bypass combination point 142*a* of the second liquid guide tube 141.

The second bypass combination point 142*a* may be defined at a point between the second flow valve 144 and the second heat exchanger 102 in the second liquid guide tube 142.

Specifically, the second bypass combination point 142*a* may be defined at a point corresponding to a point between the second flow valve 144 and the second strainer 149*b*.

Alternatively, the second bypass combination point 142*a* may be defined at a point corresponding to a point between the second flow valve 144 and the second liquid refrigerant sensor 147.

The air conditioning apparatus 1 may further include bypass valves 215 and 225 installed in each of the bypass tubes 210 and 220.

Each of the flow valves 215 and 225 may adjust a flow rate of the refrigerant by adjusting an opening degree thereof.

Each of the bypass valves 215 and 225 may include an electronic expansion valve (EEV). Also, each of the bypass valves 215 and 225 may be adjusted in opening degree to adjust a pressure of the refrigerant passing therethrough.

The bypass valve 215 includes a first bypass valve 215 installed in the second bypass tube 210 and a second bypass valve 225 installed in the third bypass tube 220.

Therefore, the first bypass valve 215 and the second bypass valve 225 may be opened or closed to selectively supply the high-pressure refrigerant flowing through the high-pressure gas tube 20 to the first heat exchanger 101 or the second heat exchanger 102. Thus, the first heat exchanger 101 and the second heat exchanger 102 may be prevented from being frozen to burst.

The air conditioning apparatus 1 may further include a controller (not shown).

The controller (not shown) may control operations of the high-pressure valves 123 and 124, the low-pressure valves 127 and 128, the pressure equalization valves 135 and 136, and the flow valves 143 and 144, which are described so that the operation mode of the heat exchangers 101 and 102 are switched according to the heating or cooling mode required in the plurality of indoor units 61, 62, 63, and 64.

Also, the controller may adjust an opening degrees of each of the bypass valves 215 and 225 based on the refrigerant temperature detected by the refrigerant sensor.

The heat exchange device 100 may further include heat exchanger inlet tubes 161 and 163 connected to the water passages of the heat exchanger 101 and 102 and heat exchanger discharge outlet tubes 162 and 164.

The heat exchanger inlet tubes 161 and 163 include a first heat exchanger inlet tube 161 connected to an inlet of the water passage of the first heat exchanger 101 and a second heat exchanger inlet tube 163 to be connected to an inlet of the water passage of the second heat exchanger 102.

The heat exchanger outlet tubes 162 and 164 include a first heat exchanger outlet tube 162 connected to an outlet of the water passage of the first heat exchanger 101 and a second heat exchanger outlet tube 164 to be connected to an outlet of the water passage of the second heat exchanger 102.

A first pump 151 may be provided in the first heat exchanger inlet tube 161, and a second pump 152 may be provided in the second heat exchanger inlet tube 163.

A first combination tube 181 may be connected to the first heat exchanger inlet tube 161. A second combination tube 182 may be connected to the second heat exchanger inlet tube 163.

A third combination tube 183 may be connected to the first heat exchanger outlet tube 162. A fourth combination tube 184 may be connected to the second heat exchanger outlet tube 164.

A first water outlet tube 171 through which water discharged from each of the indoor heat exchangers 61*a*, 62*a*, 63*a*, and 64*a* flows may be connected to the first combination tube 181.

A second water outlet tube 172 through which water discharged from the indoor heat exchangers 61*a*, 62*a*, 63*a*, and 64*a* flows may be connected to the second combination tube 182.

The first water outlet tube 171 and the second water outlet tube 172 may be disposed in parallel to each other and be connected to the common water outlet tubes 651, 652, 653, and 654 communicating with the indoor heat exchangers 61*a*, 62*a*, 63*a*, and 64*a*.

The first water outlet tube 171, the second water outlet tube 172, and each of the common water outlet tubes 651, 652, 653, and 654 may be connected to each other by, for example, a three-way valve 173.

Accordingly, the water of the common water outlet tube 651, 652, 653, and 654 may flow through one of the first water outlet tube 171 and the second water outlet tube 172 by the three-way valve 173.

The common water outlet tubes 651, 652, 653, and 654 may be connected to the outlet tubes of the indoor heat exchangers 61*a*, 62*a*, 63*a*, and 64*a*, respectively.

First water inlet tubes 165*a*, 165*b*, 165*c*, and 165*d* through which water to be introduced into each indoor heat exchanger 61*a*, 62*a*, 63*a*, and 64*a* flows may be connected to the third combination tube 183.

A second water inlet tube 167*d* through which water to be introduced into each of the indoor heat exchangers 61*a*, 62*a*, 63*a*, and 64*a* flows may be connected to the fourth combination tube 184.

The first water inlet tubes 165*a*, 165*b*, 165*c*, and 165*d* and the second water inlet tube 167*d* may be arranged in parallel to each other and be connected to the common inlet tubes 611, 621, 631, and 641 communicating with the indoor heat exchangers 61*a*, 62*a*, 63*a*, and 64*a*.

Each of the first water inlet tubes 165*a*, 165*b*, 165*c*, and 165*d* may be provided with a first valve 166, and the second water inlet tubes 167*d* may be provided with a second valve 167.

An operation in which all the operation modes of the plurality of indoor units 61, 62, 63 and 64 are the same is referred to as an "exclusive operation". The dedicated operation may be understood as a case in which the indoor heat exchangers 61*a*, 62*a*, 63*a*, and 64*a* of the plurality of indoor units 61, 62, 63, and 64 operate only as the evaporators or as the condensers. Here, the plurality of indoor heat exchangers 61*a*, 62*a*, 63*a*, and 64*a* may be based on an operating (ON) heat exchanger rather than a stopped (OFF) heat exchanger.

Also, the operations of the plurality of indoor units 61, 62, 63, 64 in different operation modes are referred to as a "simultaneous operation". The simultaneous operation may be understood as a case in which some of the plurality of indoor heat exchangers 61*a*, 62*a*, 63*a*, and 64*a* operate as the condenser, and the remaining indoor heat exchangers operate as the evaporator.

Figure 3:
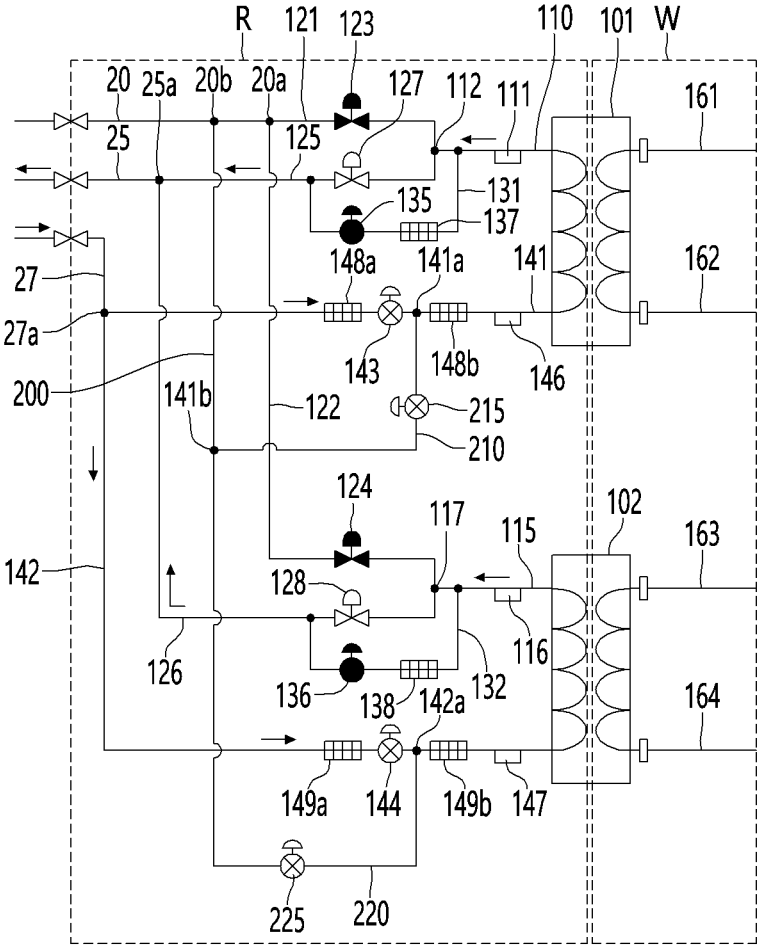
FIG. 3 is a cycle diagram illustrating a flow of a refrigerant in a heat exchange device during a cooling operation of the air conditioning apparatus according to an embodiment.

FIG. 3 is a cycle diagram illustrating a flow of the refrigerant in the heat exchange device during the cooling operation of the air conditioning apparatus according to an embodiment.

Referring to FIG. 3, when the air conditioning apparatus 1 performs the cooling operation (when a number of indoor units perform the cooling operation), a high-pressure liquid refrigerant condensed in the outdoor heat exchanger 15 of the outdoor unit 10 is introduced into the switching unit R through the liquid tube.

A portion of the refrigerant introduced into the liquid tube 27 is branched at the liquid tube branch point 27*a* to flow into the first liquid guide tube 141, and the other portion of the refrigerant is branched at the liquid tube branch point 27*a* to flow into the second liquid guide tube 142.

The condensed refrigerant introduced into the first liquid guide tube 141 may be expanded while passing through the first flow valve 143. In addition, the expanded refrigerant may be evaporated by absorbing heat of water while passing through the first heat exchanger 101.

A temperature of the refrigerant flowing into the first heat exchanger 101 may be detected by the first liquid refrigerant sensor 146.

The evaporated refrigerant discharged from the first heat exchanger 101 may be introduced into the first low-pressure guide tube 125 through the first refrigerant tube 110 to flow to the low-pressure gas tube 25. Here, the first low-pressure valve 127 is opened, and the first high-pressure valve 123 is closed.

A temperature of the refrigerant discharged from the first heat exchanger 101 may be detected by the first gas refrigerant sensor 111.

Likewise, the condensed refrigerant introduced into the second liquid guide tube 142 may be expanded while passing through the second flow valve 144. Also, the expanded refrigerant may be evaporated by absorbing heat of water while passing through the second heat exchanger 102.

A temperature of the refrigerant flowing into the first heat exchanger 102 may be detected by the second liquid refrigerant sensor 147.

Likewise, the evaporated refrigerant discharged from the second heat exchanger 102 may be introduced into the second low-pressure guide tube 126 through the second refrigerant tube 115 to flow to the low-pressure gas tube 25. Here, the second low-pressure valve 128 is opened, and the second high-pressure valve 124 is closed.

A temperature of the refrigerant discharged from the second heat exchanger 102 may be detected by the second gas refrigerant sensor 116.

The refrigerant introduced into the low-pressure gas tube 27 may be suctioned into the compressor 11 of the outdoor unit 10 and then condensed in the outdoor heat exchanger 15 of the outdoor unit 10. This refrigerant cycle may be circulated.

Figure 4:
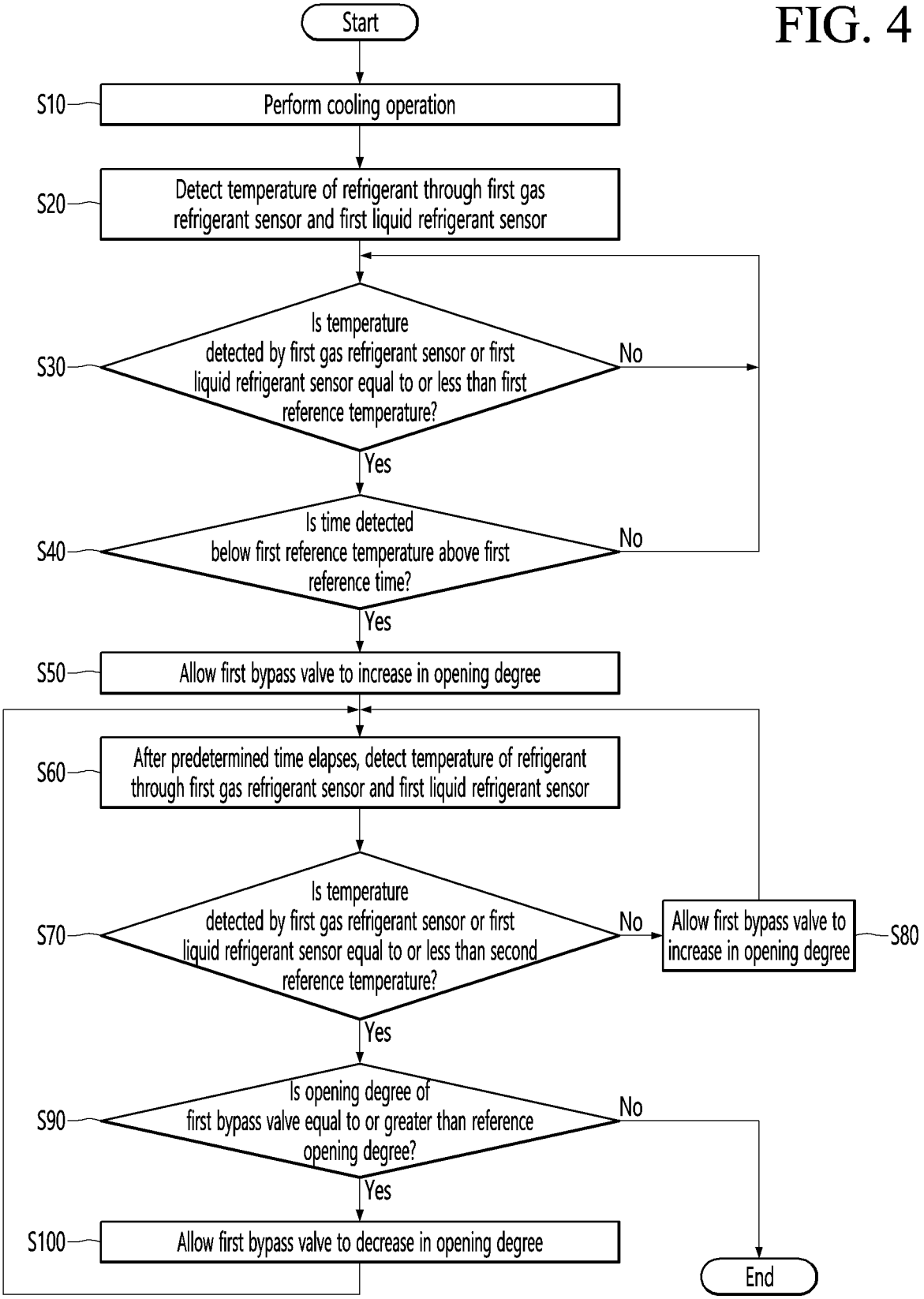
FIG. 4 is a flowchart illustrating a method for controlling the air conditioning apparatus to prevent the heat exchanger from being frozen to burst during the cooling operation according to an embodiment.

FIG. 4 is a flowchart illustrating a method for controlling the air conditioning apparatus to prevent the heat exchanger from being frozen to burst during the cooling operation according to an embodiment.

In FIG. 4, a method for preventing the first heat exchanger 101 from being frozen to burst during the cooling operation will be described as an example. However, the embodiment is not limited thereto, and a method for preventing the second heat exchanger 102 from being frozen to burst may be applied in the same manner.

Referring to FIGS. 3 and 4 together, in operation S10, an air conditioning apparatus 1 performs a cooling operation.

As described above, an outdoor heat exchanger 15 of an outdoor unit 10 may function as a condenser, and a plurality of indoor units 61, 62, 63, and 64 may operate for cooling. In this case, each of a first heat exchanger 101 and a second heat exchanger 102 may function as an evaporator for evaporating a refrigerant.

That is, a refrigerant condensed in the outdoor heat exchanger 15 may be evaporated while passing through the first heat exchanger 101 and the second heat exchanger 102.

In operation S20, the air conditioning apparatus 1 detects a temperature of the refrigerant through a first gas refrigerant sensor 111 and a first liquid refrigerant sensor 146.

A temperature of the refrigerant introduced into the first heat exchanger 101 may be detected by the first liquid refrigerant sensor 146, and a temperature of the refrigerant discharged from the first heat exchanger 101 may be detected by the first gas refrigerant sensor 111.

In operation S30, the air conditioning apparatus 1 may determine whether the temperature detected by the first gas refrigerant sensor 111 or the first liquid refrigerant sensor 146 is less than or equal to a first reference temperature.

In detail, to detect a risk of freezing and bursting of the first heat exchanger 101, the air conditioning apparatus 1 determines whether each of the temperature of the refrigerant introduced into the first heat exchanger 101 and the temperature of the refrigerant discharged from the first heat exchanger 101 is less than or equal to the first reference temperature.

When each of the temperature of the refrigerant introduced into the first heat exchanger 101 or the temperature of the refrigerant discharged from the first heat exchanger 101 is very low, the water flowing through the first heat exchanger 101 may be frozen to burst. In this case, the first reference temperature may be, for example, about 0 degree, which is a temperature at which water is frozen.

When the temperature detected by the first gas refrigerant sensor 111 or the first liquid refrigerant sensor 146 is less than or equal to the first reference temperature, in operation S40, the air conditioning apparatus 1 determines whether a time at which the temperature of the refrigerant is detected to be less than or equal to the first reference temperature is equal to or greater than a reference time.

That is, if the time at which the temperature of the refrigerant is detected below a first reference temperature is maintained for the reference time or more, since possibility of freezing and bursting of the first heat exchanger 101 is high, a time for which the temperature state maintained below the first reference temperature is detected may be confirmed. Here, the reference time may be, for example, about 1 minute.

When the time for which the refrigerant temperature is detected below the first reference temperature is equal to or greater than the reference time, the air conditioning apparatus 1 opens the first bypass valve 215 in operation S50.

In detail, when there is a risk of freezing and bursting of the first heat exchanger 101, the air conditioning apparatus 1 opens the first bypass valve 215 to supply the high-temperature high-pressure refrigerant to the first heat exchanger 101.

The air conditioning apparatus 1 may set an opening degree of the first bypass valve 215 as an initial opening value. Here, the initial opening value may be a maximum opening angle of the first bypass valve 215. For example, the initial opening value may be about 500 pls (pulses).

When the first bypass valve 215 is opened, the high-temperature high-pressure refrigerant flowing through the high-pressure gas tube 20 may be introduced into the first heat exchanger 101 through the common tube 200 and the second bypass tube 210. Accordingly, an internal temperature of the first heat exchanger 101 may gradually increase to prevent the heat exchanger from being frozen to burst.

In operation S60, the air conditioning apparatus 1 detects a temperature of the refrigerant through a first gas refrigerant sensor 111 and a first liquid refrigerant sensor 146 after a predetermined time elapses.

In operation S70, the air conditioning apparatus 1 may determine whether the temperature detected by each of the first gas refrigerant sensor 111 and the first liquid refrigerant sensor 146 is less than or equal to a second reference temperature.

Here, the second reference temperature may be, for example, about 3 degrees.

That is, when the temperature detected by each of the first gas refrigerant sensor 111 and the first liquid refrigerant sensor 146 is about 3 degrees or more, the air conditioning apparatus 1 determines that there is little risk of freezing or bursting of the heat exchanger.

If the temperature detected by each of the first gas refrigerant sensor 111 and the first liquid refrigerant sensor 146 is less than the second reference temperature, in operation S80, the air conditioning apparatus 1 allows the first bypass valve 215 to increase in opening degree.

For example, if the temperature detected by each of the first gas refrigerant sensor 111 and the first liquid refrigerant sensor 146 is less than the second reference temperature (e.g., about 3 degrees), the air conditioning apparatus 1 may determine that there is still a risk that the heat exchanger is frozen to burst and thus allow the first bypass valve 215 to increase in opening degree by about 50 pulses.

On the other hand, when the temperature detected by each of the first gas refrigerant sensor 111 and the first liquid refrigerant sensor 146 is equal to or greater than the second reference temperature, in operation S90, the air conditioning apparatus 1 determine whether the opening degree of the first bypass valve 215 is equal to or greater than the reference opening value, and when the opening degree of the first bypass valve 212 is equal to or greater than the reference opening value, the opening degree of the first bypass valve 215 decreases in operation S100, In detail, when the temperatures detected by each of the first gas refrigerant sensor 111 and the first liquid refrigerant sensor 146 is equal to or greater than the second reference temperature (e.g., about 3 degrees), it is determined that there is no risk of freezing and bursting of the heat exchanger.

However, when the opening value of the first bypass valve 215 is too large, an amount of high-pressure refrigerant introduced into the first heat exchanger 101 increases, and as a result, performance of the heat exchanger may be deteriorated. Thus, the amount of high-pressure refrigerant introduced into the first heat exchanger 101 may be adjusted to prevent the heat exchanger from being frozen to burst and also maintain the performance of the heat exchanger.

For example, when the opening degree of the first bypass valve 215 is above about 40 pulses to about 60 pulses, the air conditioning apparatus 1 may reduce the opening degree of the first bypass valve 215 by about 50 pulses. Also, the air conditioning apparatus 1 may enter operation S60 again.

According to this algorithm, the opening value of the first bypass valve 215 may be appropriately adjusted.

If the opening degree of the first bypass valve 215 is less than the reference opening value (e.g., about 40 pulses), the air conditioning apparatus 1 may terminate this algorithm.

On the other hand, in operation S70, if the temperature detected by each of the first gas refrigerant sensor 111 and the first liquid refrigerant sensor 146 is equal to or greater than the second reference temperature, the operation S90 may be omitted, and the process may proceed to operation S100 that is a next process to reduce the opening degree of the first bypass valve 215.

Figure 5:
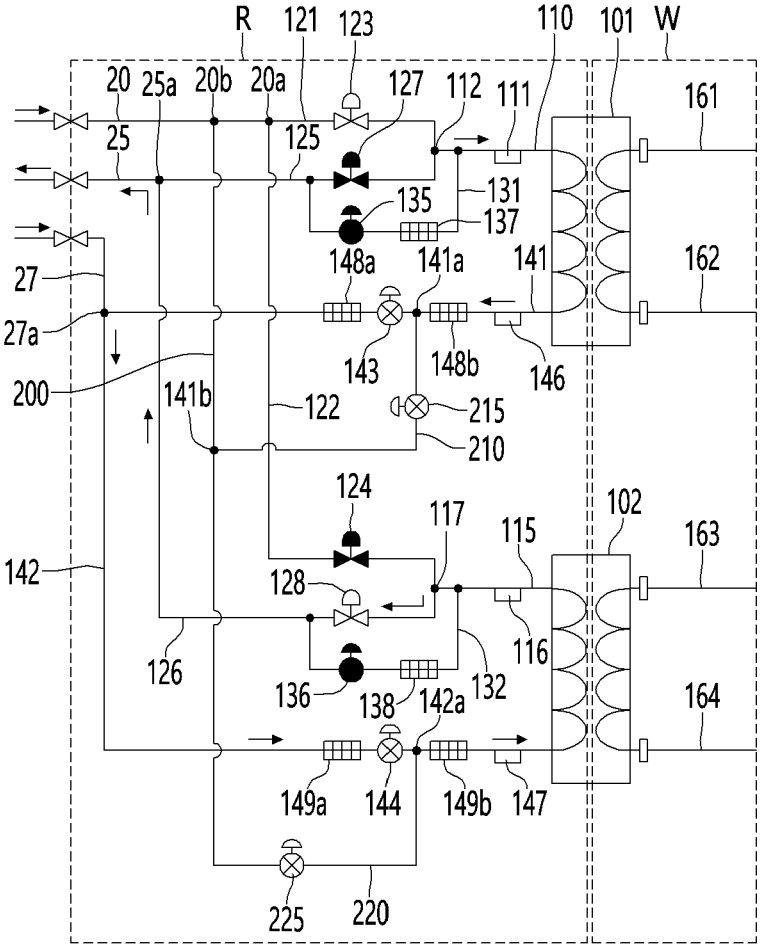
FIG. 5 is a cycle diagram illustrating a flow of the refrigerant in the heat exchange device during a simultaneous operation of the air conditioning apparatus according to an embodiment.

FIG. 5 is a cycle diagram illustrating a flow of the refrigerant in the heat exchange device during the simultaneous operation of the air conditioning apparatus according to an embodiment.

Referring to FIG. 5, when the air conditioning apparatus 1 performs a simultaneous operation (some of the plurality of indoor units perform the cooling operation, and remaining indoor units perform the heating operation), the high-temperature gas refrigerant compressed in the compressors 10 and 11 is introduced into the switching unit R through the high-pressure gas tube 20.

The refrigerant introduced into the high-pressure gas tube 20 is introduced into the first refrigerant tube 110 through the first high-pressure guide tube 121. Here, the first high-pressure valve 123 is opened, and the first low-pressure valve 127 is closed.

The compressed refrigerant introduced into the first refrigerant tube 110 may be introduced into the first heat exchanger 101 and may be condensed by being heat-exchanged with water.

Here, the water absorbing heat of the refrigerant may be circulated through the indoor units 61 and 62, which require the heating operation.

A temperature of the refrigerant flowing into the first heat exchanger 101 may be detected by the first gas refrigerant sensor 111.

A temperature of the refrigerant discharged from the first heat exchanger 101 may be detected by the first liquid refrigerant sensor 146.

The condensed refrigerant passing through the first heat exchanger 101 may flow to the liquid tube branch point 27*a* through the first liquid guide tube 141. Also, the condensed refrigerant may be branched from the liquid tube branch point 27*a* to pass through the second flow valve 144 through the second liquid guide tube 142.

Here, the second flow valve 144 may operate as an expansion valve that expands the refrigerant by adjusting the opening degree thereof.

The expanded refrigerant passing through the second flow valve 144 may be evaporated by being heat-exchanged with the water while passing through the second heat exchanger 102.

Here, the water cooled by heat exchange with the refrigerant may be circulated through the indoor units 63 and 64 requiring the cooling operation.

The evaporated refrigerant passing through the second heat exchanger 102 may flow to the second low-pressure guide tube 126 through the second refrigerant tube 115.

Here, the second low-pressure valve 128 is opened, and the second high-pressure valve 124 is closed.

Also, the evaporated refrigerant may be introduced into the low-pressure gas tube 25 and collected into the compressors 110 and 11 of the outdoor unit 10.

A temperature of the refrigerant flowing into the first heat exchanger 102 may be detected by the second liquid refrigerant sensor 147.

A temperature of the refrigerant discharged from the second heat exchanger 102 may be detected by the second gas refrigerant sensor 116.

Figure 6:
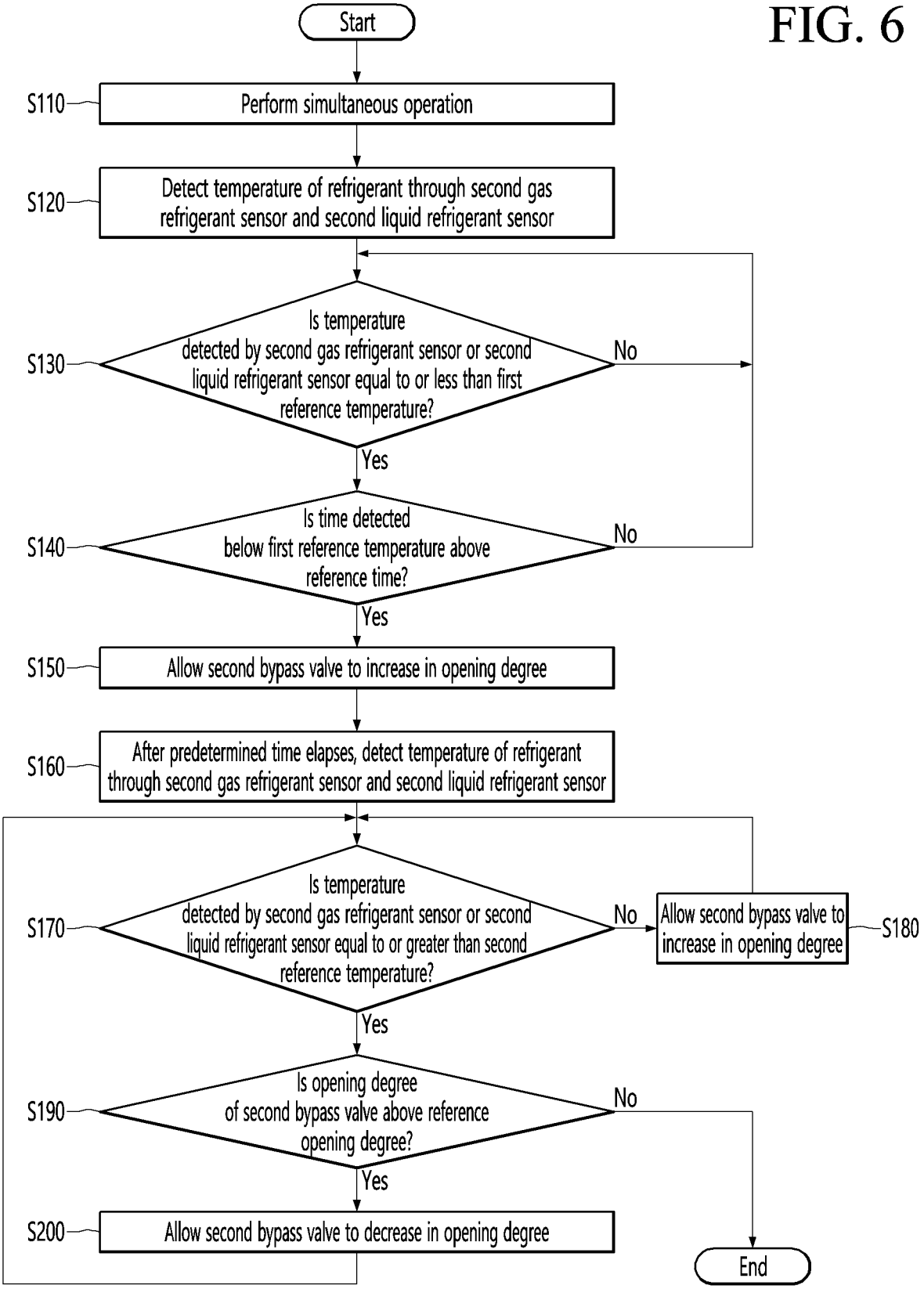
FIG. 6 is a flowchart illustrating a method for controlling the air conditioning apparatus to prevent the heat exchanger from being frozen to burst during the simultaneous operation according to an embodiment.

FIG. 6 is a flowchart illustrating a method for controlling the air conditioning apparatus to prevent the heat exchanger from being frozen to burst during the simultaneous operation according to an embodiment.

In FIG. 6, a method for preventing the first heat exchanger 102 from being frozen to burst during the simultaneous operation will be described as an example.

Referring to FIGS. 5 and 6 together, in operation S110, the air conditioning apparatus 1 performs the simultaneous operation.

As described above, some of the indoor units 61 and 62 of the plurality of indoor units 61, 62, 63, and 64 may operate for the heating, and the remaining indoor units 63 and 64 may operate for the cooling. In this case, the first heat exchanger 101 may function as the condenser for condensing the refrigerant, and the second heat exchanger 102 may function as the evaporator for evaporating the refrigerant.

That is, the high-temperature refrigerant compressed by the compressor 11 of the outdoor unit 10 may be condensed in the first heat exchanger 101 and then evaporated in the second heat exchanger 102.

In operation S120, the air conditioning apparatus 1 detects a temperature of the refrigerant through the second gas refrigerant sensor 116 and the second liquid refrigerant sensor 147.

A temperature of the refrigerant introduced into the second heat exchanger 102 may be detected by the second liquid refrigerant sensor 147, and a temperature of the refrigerant discharged from the second heat exchanger 102 may be detected by the second gas refrigerant sensor 116.

Here, the reason for detecting the temperature of the refrigerant flowing through the second heat exchanger 102 is that there is a risk of freezing and bursting of only the second heat exchanger 102 because the second heat exchanger 102 functions as the evaporator during the simultaneous operation. That is, in this case, since the first heat exchanger 101 functions as the condenser, there is no risk of freezing or bursting.

In operation S130, the air conditioning apparatus 1 may determine whether the temperature detected by the second gas refrigerant sensor 116 or the second liquid refrigerant sensor 147 is less than or equal to a first reference temperature.

In detail, to detect a risk of freezing and bursting of the second heat exchanger 102, the air conditioning apparatus 1 determines whether each of the temperature of the refrigerant introduced into the second heat exchanger 102 and the temperature of the refrigerant discharged from the second heat exchanger 102 is less than or equal to the first reference temperature.

When each of the temperature of the refrigerant introduced into the second heat exchanger 102 or the temperature of the refrigerant discharged from the second heat exchanger 102 is very low, the water flowing through the second heat exchanger 102 may be frozen to burst. In this case, the first reference temperature may be, for example, about 0 degree, which is a temperature at which water is frozen.

When the temperature detected by the second gas refrigerant sensor 116 or the second liquid refrigerant sensor 147 is less than or equal to the first reference temperature, in operation S140, the air conditioning apparatus 1 determines whether a time at which the temperature of the refrigerant is detected to be less than or equal to the first reference temperature is equal to or greater than a reference time.

That is, if the time at which the temperature of the refrigerant is detected below a first reference temperature is maintained for the reference time or more, since possibility of freezing and bursting of the second heat exchanger 102 is high, a time for which the temperature state maintained below the first reference temperature is detected may be confirmed. Here, the reference time may be, for example, about 1 minute.

When the time for which the refrigerant temperature is detected below the first reference temperature is equal to or greater than the reference time, the air conditioning apparatus 1 opens the second bypass valve 225 in operation S150.

In detail, when there is a risk of freezing and bursting of the second heat exchanger 102, the air conditioning apparatus 1 opens the second bypass valve 225 to supply the high-temperature refrigerant to the second heat exchanger 102.

The air conditioning apparatus 1 may set an opening degree of the second bypass valve 225 as an initial opening value. Here, the initial opening value may be a maximum opening angle of the second bypass valve 225. For example, the initial opening value may be about 500 pls (pulses).

When the second bypass valve 225 is opened, the high-temperature high-pressure refrigerant flowing through the high-pressure gas tube 20 may be introduced into the second heat exchanger 102 through the common tube 200 and the third bypass tube 210. Accordingly, an internal temperature of the second heat exchanger 102 may gradually increase to prevent the heat exchanger from being frozen to burst.

In operation S160, the air conditioning apparatus 1 detects a temperature of the refrigerant through a second gas refrigerant sensor 116 and a third liquid refrigerant sensor 147 after a predetermined time elapses.

In operation S170, the air conditioning apparatus 1 may determine whether the temperature detected by each of the second gas refrigerant sensor 116 and the second liquid refrigerant sensor 147 is less than or equal to a second reference temperature.

Here, the second reference temperature may be, for example, about 3 degrees.

That is, when the temperature detected by each of the second gas refrigerant sensor 116 and the second liquid refrigerant sensor 147 is about 3 degrees or more, the air conditioning apparatus 1 determines that there is little risk of freezing or bursting of the heat exchanger.

If the temperature detected by each of the second gas refrigerant sensor 116 and the second liquid refrigerant sensor 147 is less than the second reference temperature, in operation S180, the air conditioning apparatus 1 allows the second bypass valve 225 to increase in opening degree.

For example, if the temperature detected by each of the second gas refrigerant sensor 116 and the second liquid refrigerant sensor 147 is less than the second reference temperature (e.g., about 3 degrees), the air conditioning apparatus 1 may determine that there is a risk that the heat exchanger is frozen to burst and thus allow the second bypass valve 225 to increase in opening degree by about 50 pulses.

On the other hand, when the temperature detected by each of the second gas refrigerant sensor 116 and the second liquid refrigerant sensor 147 is equal to or greater than the second reference temperature, in operation S190, the air conditioning apparatus 1 determine whether the opening degree of the second bypass valve 225 is equal to or greater than the reference opening value, and when the opening degree of the second bypass valve 225 is equal to or greater than the reference opening value, the opening degree of the second bypass valve 225 decreases in operation S200, In detail, when the temperatures detected by each of the second gas refrigerant sensor 116 and the second liquid refrigerant sensor 147 is equal to or greater than the second reference temperature (e.g., about 3 degrees), it is determined that there is no risk of freezing and bursting of the heat exchanger.

However, when the opening value of the second bypass valve 225 is too large, an amount of high-temperature refrigerant introduced into the second heat exchanger 102 increases, and as a result, performance of the heat exchanger may be deteriorated. Thus, the amount of high-temperature refrigerant introduced into the second heat exchanger 102 may be adjusted to prevent the heat exchanger from being frozen to burst and also maintain the performance of the heat exchanger.

For example, when the opening degree of the second bypass valve 225 is above about 40 pulses to about 60 pulses, the air conditioning apparatus 1 may reduce the opening degree of the second bypass valve 225 by about 50 pulses. Also, the air conditioning apparatus 1 may enter operation S160 again.

According to this algorithm, the opening value of the second bypass valve 225 may be adjusted.

If the opening degree of the second bypass valve 225 is less than the reference opening value (e.g., about 40 pulses), the air conditioning apparatus 1 may terminate this algorithm.

On the other hand, in operation S170, if the temperature detected by each of the second gas refrigerant sensor 116 and the second liquid refrigerant sensor 147 is equal to or greater than the second reference temperature, the operation S90 may be omitted, and the process may proceed to operation S200 that is a next process to reduce the opening degree of the second bypass valve 225.

Figure 7:
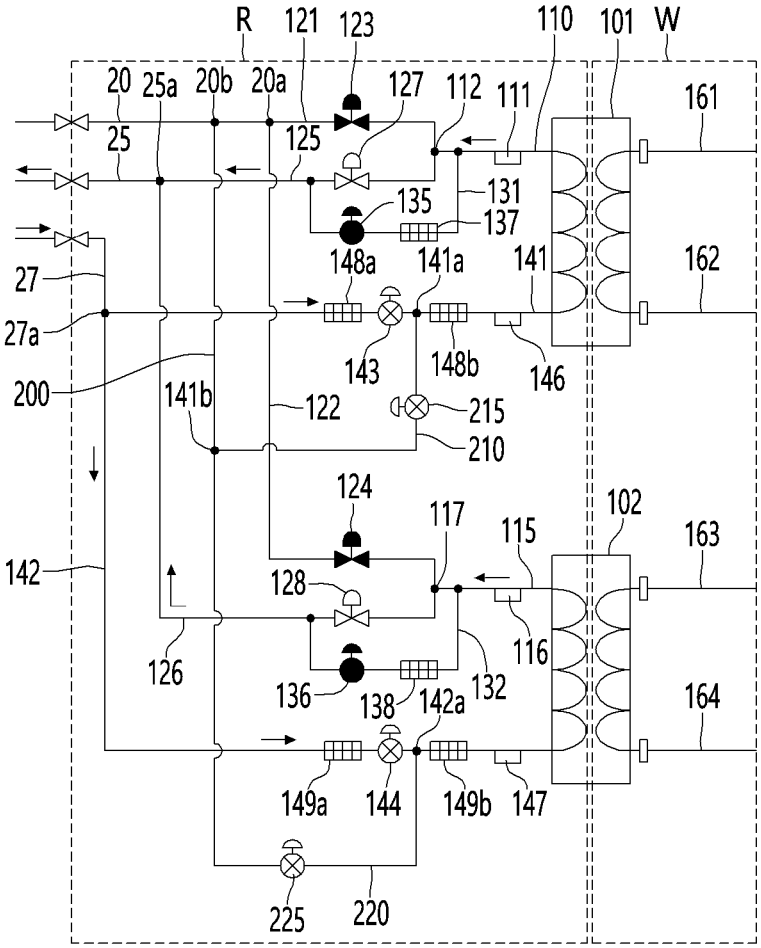
FIG. 7 is a cycle diagram illustrating a flow of the refrigerant in the heat exchange device during an oil collection operation of the air conditioning apparatus according to an embodiment.

FIG. 7 is a cycle diagram illustrating a flow of the refrigerant in the heat exchange device during an oil collection operation of the air conditioning apparatus according to an embodiment.

Referring to FIG. 7, the air conditioning apparatus 1 may perform an oil collection operation during the heating operation.

Here, the oil collection operation may be understood as an operation mode for collecting oil accumulated in the gas tube in addition to the tube and the heat exchanger when an oil shortage phenomenon occurs in the compressor during a long heating operation.

That is, when the air conditioning apparatus 1 performs the oil collection operation, it may be switched to the cooling mode through a cooling/heating switching valve (not shown). Here, an operation frequency of the compressor may increase to reduce the time for collecting the oil.

When the air conditioning apparatus 1 performs the oil collection operation, the high-pressure liquid refrigerant condensed in the outdoor heat exchanger 15 of the outdoor unit 10 is introduced into the switching unit R through the liquid tube.

A portion of the refrigerant introduced into the liquid tube 27 is branched at the liquid tube branch point 27*a* to flow into the first liquid guide tube 141, and the other portion of the refrigerant is branched at the liquid tube branch point 27*a* to flow into the second liquid guide tube 142.

The condensed refrigerant introduced into the first liquid guide tube 141 may be expanded while passing through the first flow valve 143. In addition, the expanded refrigerant may be evaporated by absorbing heat of water while passing through the first heat exchanger 101.

A temperature of the refrigerant flowing into the first heat exchanger 101 may be detected by the first liquid refrigerant sensor 146.

The evaporated refrigerant discharged from the first heat exchanger 101 may be introduced into the first low-pressure guide tube 125 through the first refrigerant tube 110 to flow to the low-pressure gas tube 25. Here, the first low-pressure valve 127 is opened, and the first high-pressure valve 123 is closed.

A temperature of the refrigerant discharged from the first heat exchanger 101 may be detected by the first gas refrigerant sensor 111.

Likewise, the condensed refrigerant introduced into the second liquid guide tube 142 may be expanded while passing through the second flow valve 144. Also, the expanded refrigerant may be evaporated by absorbing heat of water while passing through the second heat exchanger 102.

A temperature of the refrigerant flowing into the first heat exchanger 102 may be detected by the second liquid refrigerant sensor 147.

Likewise, the evaporated refrigerant discharged from the second heat exchanger 102 may be introduced into the second low-pressure guide tube 126 through the second refrigerant tube 115 to flow to the low-pressure gas tube 25. Here, the second low-pressure valve 128 is opened, and the second high-pressure valve 124 is closed.

A temperature of the refrigerant discharged from the second heat exchanger 102 may be detected by the second gas refrigerant sensor 116.

The refrigerant introduced into the low-pressure gas tube 27 may be suctioned into the compressor 11 of the outdoor unit 10 and then condensed in the outdoor heat exchanger 15 of the outdoor unit 10. This refrigerant cycle may be circulated.

Figure 8:
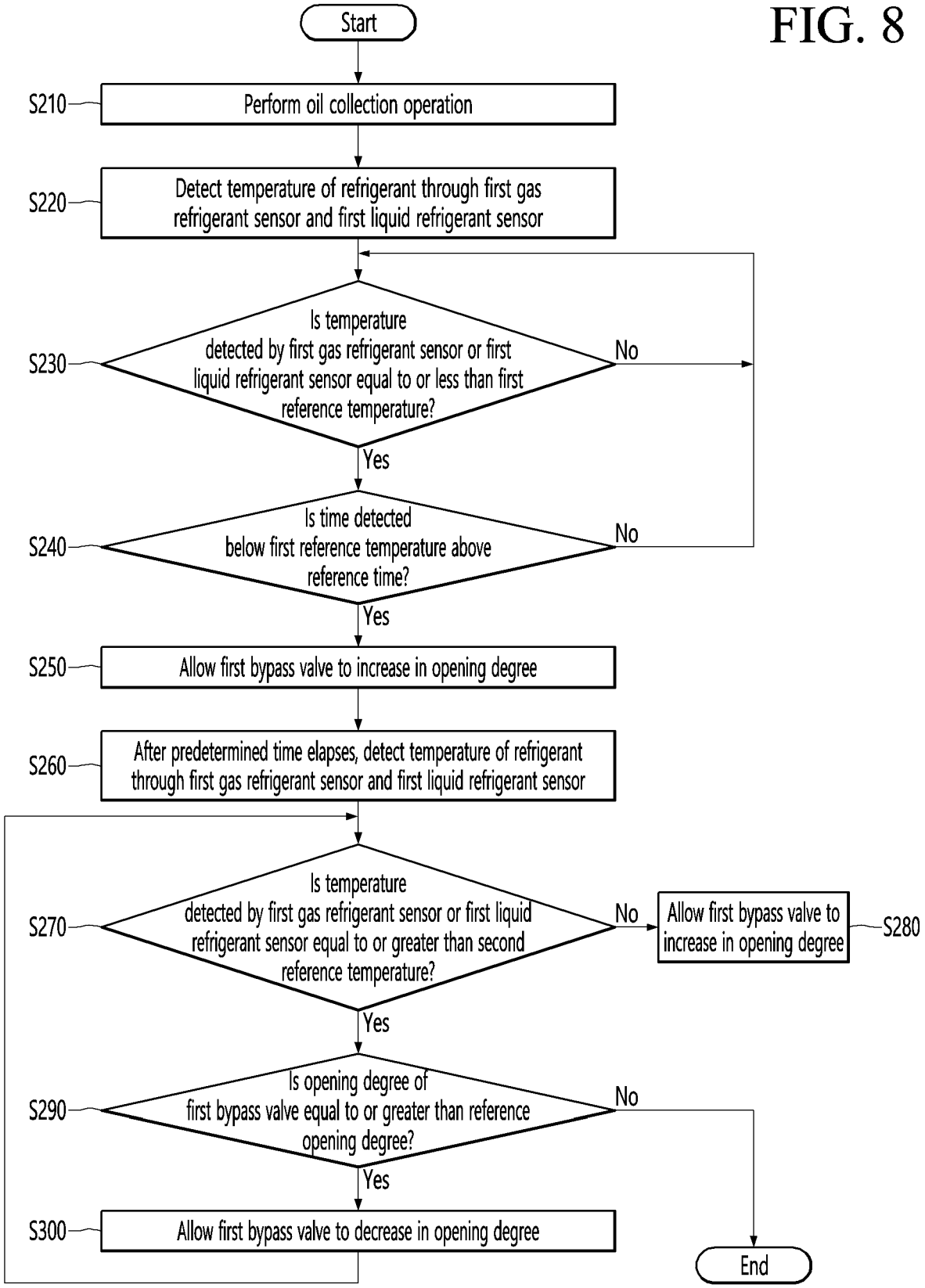
FIG. 8 is a flowchart illustrating a method for controlling the air conditioning apparatus to prevent the heat exchanger from being frozen to burst during the oil collection operation according to an embodiment.

FIG. 8 is a flowchart illustrating a method for controlling the air conditioning apparatus to prevent the heat exchanger from being frozen to burst during the oil collection operation according to an embodiment.

In FIG. 8, a method for preventing the first heat exchanger 101 from being frozen to burst during the oil collection operation will be described as an example. However, the embodiment is not limited thereto, and a method for preventing the second heat exchanger 102 from being frozen to burst may be applied in the same manner.

Referring to FIGS. 7 and 8 together, the air conditioning apparatus 1 performs the oil collection operation in operation S210.

As described above, when the oil shortage phenomenon of the compressor occurs during the heating operation, the air conditioning apparatus 1 may perform the oil collection operation to collect the oil accumulated in the gas tube.

The air conditioning apparatus 1 is switched from the heating operation to the cooling operation, the outdoor heat exchanger 15 of the outdoor unit 10 may function as the condenser, and the plurality of indoor units 61, 62, 63, and 64 may operate for the cooling. In this case, each of a first heat exchanger 101 and a second heat exchanger 102 may function as an evaporator for evaporating a refrigerant.

That is, a refrigerant condensed in the outdoor heat exchanger 15 may be evaporated while passing through the first heat exchanger 101 and the second heat exchanger 102.

In operation S220, the air conditioning apparatus 1 detects a temperature of the refrigerant through a first gas refrigerant sensor 111 and a first liquid refrigerant sensor 146.

A temperature of the refrigerant introduced into the first heat exchanger 101 may be detected by the first liquid refrigerant sensor 146, and a temperature of the refrigerant discharged from the first heat exchanger 101 may be detected by the first gas refrigerant sensor 111.

In operation S230, the air conditioning apparatus 1 may determine whether the temperature detected by the first gas refrigerant sensor 111 or the first liquid refrigerant sensor 146 is less than or equal to a first reference temperature.

In detail, to detect a risk of freezing and bursting of the first heat exchanger 101, the air conditioning apparatus 1 determines whether each of the temperature of the refrigerant introduced into the first heat exchanger 101 and the temperature of the refrigerant discharged from the first heat exchanger 101 is less than or equal to the first reference temperature.

When each of the temperature of the refrigerant introduced into the first heat exchanger 101 or the temperature of the refrigerant discharged from the first heat exchanger 101 is very low, the water flowing through the first heat exchanger 101 may be frozen to burst. In this case, the first reference temperature may be, for example, about 0 degree, which is a temperature at which water is frozen.

When the temperature detected by the first gas refrigerant sensor 111 or the first liquid refrigerant sensor 146 is less than or equal to the first reference temperature, in operation S240, the air conditioning apparatus 1 determines whether a time at which the temperature of the refrigerant is detected to be less than or equal to the first reference temperature is equal to or greater than a reference time.

That is, if the time at which the temperature of the refrigerant is detected below a first reference temperature is maintained for the reference time or more, since possibility of freezing and bursting of the first heat exchanger 101 is high, a time for which the temperature state maintained below the first reference temperature is detected may be confirmed. Here, the reference time may be, for example, about 1 minute.

When the time for which the refrigerant temperature is detected below the first reference temperature is equal to or greater than the reference time, the air conditioning apparatus 1 opens the first bypass valve 215 in operation S250.

In detail, when there is a risk of freezing and bursting of the first heat exchanger 101, the air conditioning apparatus 1 opens the first bypass valve 215 to supply the high-temperature high-pressure refrigerant to the first heat exchanger 101.

The air conditioning apparatus 1 may set an opening degree of the first bypass valve 215 as an initial opening value. Here, the initial opening value may be a maximum opening angle of the first bypass valve 215. For example, the initial opening value may be about 500 pls (pulses).

When the first bypass valve 215 is opened, the high-pressure refrigerant flowing through the high-pressure gas tube 20 may be introduced into the first heat exchanger 101 through the common tube 200 and the second bypass tube 210. Accordingly, an internal temperature of the first heat exchanger 101 may gradually increase to prevent the heat exchanger from being frozen to burst.

In operation S260, the air conditioning apparatus 1 detects a temperature of the refrigerant again through a first gas refrigerant sensor 111 and a first liquid refrigerant sensor 146 after a predetermined time elapses.

In operation S270, the air conditioning apparatus 1 may determine whether the temperature detected by each of the first gas refrigerant sensor 111 and the first liquid refrigerant sensor 146 is less than or equal to a second reference temperature.

Here, the second reference temperature may be, for example, about 3 degrees.

That is, when the temperature detected by each of the first gas refrigerant sensor 111 and the first liquid refrigerant sensor 146 is about 3 degrees or more, the air conditioning apparatus 1 determines that there is little risk of freezing or bursting of the heat exchanger.

If the temperature detected by each of the first gas refrigerant sensor 111 and the first liquid refrigerant sensor 146 is less than the second reference temperature, in operation S280, the air conditioning apparatus 1 allows the first bypass valve 215 to increase in opening degree.

For example, if the temperature detected by each of the first gas refrigerant sensor 111 and the first liquid refrigerant sensor 146 is less than the second reference temperature (e.g., about 3 degrees), the air conditioning apparatus 1 may determine that there is a risk that the heat exchanger is frozen to burst and thus allow the first bypass valve 215 to increase in opening degree by about 100 pulses.

On the other hand, when the temperature detected by each of the first gas refrigerant sensor 111 and the first liquid refrigerant sensor 146 is equal to or greater than the second reference temperature, in operation S290, the air conditioning apparatus 1 determine whether the opening degree of the first bypass valve 215 is equal to or greater than the reference opening value, and when the opening degree of the first bypass valve 212 is equal to or greater than the reference opening value, the opening degree of the first bypass valve 215 decreases in operation S300, In detail, when the temperatures detected by each of the first gas refrigerant sensor 111 and the first liquid refrigerant sensor 146 is equal to or greater than the second reference temperature (e.g., about 3 degrees), it is determined that there is no risk of freezing and bursting of the heat exchanger.

However, when the opening value of the first bypass valve 215 is too large, an amount of high-temperature refrigerant introduced into the first heat exchanger 101 increases, and as a result, performance of the heat exchanger may be deteriorated. Thus, the amount of high-temperature refrigerant introduced into the first heat exchanger 101 may be adjusted to prevent the heat exchanger from being frozen to burst and also maintain the performance of the heat exchanger.

For example, when the opening degree of the first bypass valve 215 is above about 40 pulses to about 60 pulses, the air conditioning apparatus 1 may reduce the opening degree of the first bypass valve 215 by about 100 pulses. Also, the air conditioning apparatus 1 may enter operation S260 again.

According to this algorithm, the opening value of the first bypass valve 215 may be adjusted.

If the opening degree of the first bypass valve 215 is less than the reference opening value (e.g., about 40 pulses), the air conditioning apparatus 1 may terminate this algorithm.

On the other hand, in operation S270, if the temperature detected by each of the first gas refrigerant sensor 111 and the first liquid refrigerant sensor 146 is equal to or greater than the second reference temperature, the operation S290 may be omitted, and the process may proceed to operation S300 that is a next process to reduce the opening degree of the first bypass valve 215.

Particularly, during the oil collection operation, the operation frequency of the compressor may increase to quickly collect the oil. When the operation frequency of the compressor increase, the low pressure is lowered, and as a result, the pressure difference between the high and low pressures increases, and the temperature of the refrigerant passing through the heat exchanger may be lowered rapidly.

Therefore, since the possibility that the heat exchanger is frozen to burst during the oil collection operation increases, when compared to the cooling operation or the simultaneous operation described above in the foregoing embodiment, the opening degree of the first bypass valve may be significantly adjusted to effectively prevent the heat exchanger from being frozen to burst.

According to the air conditioning apparatus according to the embodiment having the above configuration has the following effects.

First, when the indoor unit performs the defrosting operation, the heat exchanger in which the refrigerant and the water are heat-exchanged with each other may be prevented from being frozen to burst.

Particularly, since the high-temperature refrigerant of the high-pressure gas tube is introduced into the heat exchanger through the liquid guide tube via the bypass tube connecting the high-pressure gas tube to the liquid guide tube, the internal temperature of the heat exchanger may increase due to the high-temperature refrigerant.

Second, even when the indoor unit performs the simultaneous operation in which the cooling operation and the heating operation are performed at the same time, the heat exchanger may be prevented from being frozen to burst.

Particularly, the temperature sensors may be installed at the inlet and outlet sides of the refrigerant passages of the plurality of heat exchangers to detect the temperature of the refrigerant flowing into each of the heat exchangers and the temperature of the refrigerant discharged from each of the heat exchangers. Therefore, when the indoor unit operates, the heat exchanger that may occur to be frozen to burst may be determined, and thus, the high-temperature refrigerant may be selectively supplied to only the corresponding heat exchanger.

Third, the temperature of the refrigerant of the heat exchanger may be continuously detected through the temperature sensor to adjust the opening degree of the bypass valve, thereby prevent the heat exchanger from being frozen to burst while maintaining the performance of the heat exchanger.

Fourth, when the oil shortage occurs in the compressor during the heating operation, during the oil collection operation for collecting the oil accumulated in the gas tube, the opening degree of the bypass valve may be adjusted to effectively prevent the heat exchanger from being frozen to burst.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioning apparatus, comprising:

an outdoor unit which comprises a compressor and an outdoor heat exchanger and through which a refrigerant is circulated;

an indoor unit through which water is circulated;

a heat exchanger in which the refrigerant and the water are heat-exchanged with each other;

a high-pressure guide tube extending from a high-pressure gas tube of the outdoor unit so as to be connected to one side of the heat exchanger;

a low-pressure guide tube extending from a low-pressure gas tube of the outdoor unit so as to be combined with the high-pressure guide tube;

a liquid guide tube extending from a liquid tube of the outdoor unit so as to be connected to the other side of the heat exchanger;

a bypass tube configured to connect a bypass branch point of the high-pressure gas tube to a bypass combination point of the liquid guide tube to bypass a high-pressure refrigerant existing in the high-pressure tube to the liquid guide tube; and a bypass valve installed in the bypass tube, wherein the heat exchanger is provided in plurality, and when some of the plurality of heat exchangers function as condensers configured to condense the refrigerant, and remaining heat exchangers function as evaporators configured to evaporate the refrigerant, the bypass valve is opened to bypass the high-pressure refrigerant of the high-pressure gas tube to the heat exchangers that function as the evaporators.

2. The air conditioning apparatus according to claim 1, wherein, when the indoor unit performs a cooling operation, the bypass valve is opened to bypass the high-pressure refrigerant of the high-pressure gas tube to the liquid guide tube.

3. The air conditioning apparatus according to claim 1, wherein, when the indoor unit performs a heating operation, the bypass valve is closed to bypass the high-pressure refrigerant of the high-pressure gas tube to the liquid guide tube.

4. The air conditioning apparatus according to claim 1, further comprising:

a high-pressure valve installed in the high-pressure guide tube, the high-pressure valve being configured to be opened and closed;

a low-pressure valve installed in the low-pressure guide tube, the low-pressure valve being configured to be opened and closed; and a flow valve installed in the liquid guide tube to control a flow rate of the refrigerant.

5. The air conditioning apparatus according to claim 4, wherein the bypass combination point is defined at a point between the heat exchanger and the flow valve.

6. An air conditioning apparatus, comprising:

an outdoor unit which comprises a compressor and an outdoor heat exchanger and through which a refrigerant is circulated;

an indoor unit through which water is circulated;

a heat exchanger in which the refrigerant and the water are heat-exchanged with each other;

a high-pressure guide tube extending from a high-pressure gas tube of the outdoor unit so as to be connected to one side of the heat exchanger;

a low-pressure guide tube extending from a low-pressure gas tube of the outdoor unit so as to be combined with the high-pressure guide tube;

a liquid guide tube extending from a liquid tube of the outdoor unit so as to be connected to the other side of the heat exchanger;

a bypass tube configured to connect a bypass branch point of the high-pressure gas tube to a bypass combination point of the liquid guide tube to bypass a high-pressure refrigerant existing in the high-pressure tube to the liquid guide tube;

a bypass valve installed in the bypass tube;

a refrigerant tube having one end defining a refrigerant branch point, at which the high-pressure guide tube and the low-pressure guide tube are combined with each other, and the other end connected to a refrigerant passage of the heat exchanger;

a gas refrigerant sensor installed in the refrigerant tube to detect a temperature of the refrigerant;

a liquid refrigerant sensor installed in the liquid guide tube to detect a temperature of the refrigerant; and a controller configured to adjust an opening degree of the bypass valve based on the temperatures detected by the gas refrigerant sensor and the liquid refrigerant sensor.

7. The air conditioning apparatus according to claim 6, wherein the controller is configured to determine whether the temperature detected by the gas refrigerant sensor or the liquid refrigerant sensor is equal to or less than a first reference temperature, and when the temperature detected by the gas refrigerant sensor or the liquid refrigerant sensor is equal to or less than the first reference temperature, the bypass valve is opened.

8. The air conditioning apparatus according to claim 7, wherein the temperatures of the refrigerant, which are detected by the gas refrigerant sensor and liquid refrigerant sensor, are detected again, and the controller is configured to determine whether each of the temperatures detected by the gas refrigerant sensor and liquid refrigerant sensor is equal to or greater than a second reference temperature.

9. The air conditioning apparatus according to claim 8, wherein, when each of the temperatures of the refrigerant, which are detected by the gas refrigerant sensor and the liquid refrigerant sensor is less than the second reference temperature, the controller is configured to control the bypass valve so that the bypass valve increases in opening degree.

10. The air conditioning apparatus according to claim 8, wherein, when each of the temperatures detected by the gas refrigerant sensor and the liquid refrigerant sensor is equal to or greater than the second reference temperature, the controller is configured to control the bypass valve so that the bypass valve decreases in opening degree.

11. The air conditioning apparatus according to claim 8, wherein, when each of the temperatures detected by the gas refrigerant sensor and the liquid refrigerant sensor is equal to or greater than the second reference temperature, the controller is configured to determine whether the opening degree of the bypass valve is equal to or greater than a reference opening degree, and when the opening degree of the bypass valve is equal to or greater than the reference opening degree, the bypass valve decreases in opening degree.

12. An air conditioning apparatus, comprising:

an outdoor unit which comprises a compressor and an outdoor heat exchanger and through which a refrigerant is circulated;

an indoor unit through which water is circulated;

a first heat exchanger and a second heat exchanger, in which the refrigerant and the water are heat-exchanged with each other;

a first high-pressure guide tube extending from a high-pressure gas tube of the outdoor unit so as to be connected to one side of the first heat exchanger;

a second high-pressure guide tube extending from the high-pressure gas tube of the outdoor unit so as to be connected to one side of the second heat exchanger;

a first low-pressure guide tube extending from a low-pressure gas tube of the outdoor unit so as to be combined with the first high-pressure guide tube;

a second low-pressure guide tube extending from the low-pressure gas tube of the outdoor unit so as to be combined with the second high-pressure guide tube;

a first liquid guide tube extending from a liquid tube of the outdoor unit so as to be connected to the other side of the first heat exchanger;

a second liquid guide tube extending from the liquid tube of the outdoor unit so as to be connected to the other side of the second heat exchanger;

a bypass tube configured to bypass a high-pressure refrigerant of the high-pressure gas tube to the first liquid guide tube or the second liquid guide tube; and a bypass valve installed in the bypass tube, wherein the bypass tube comprises:

a common tube branched from a first bypass branch portion of the high-pressure gas tube;

a first bypass tube branched from a second bypass branch portion of the common tube, the first bypass tube being connected to a first bypass combination point of the first liquid guide tube; and a second bypass tube branched from the second bypass branch portion of the common tube, the second bypass tube being connected to a second bypass combination point of the second liquid guide tube.

13. The air conditioning apparatus according to claim 12, wherein the bypass valve comprises:

a first bypass valve installed in the first bypass tube; and a second bypass valve installed in the second bypass tube.

14. The air conditioning apparatus according to claim 13, wherein, when the indoor unit performs a cooling operation, at least one or more of the first bypass valve and the second bypass valve are opened to bypass the high-pressure refrigerant of the high-pressure gas tube to at least one or more of the first liquid guide tube and the second liquid guide tube.

15. The air conditioning apparatus according to claim 12, further comprising:

a first high-pressure valve and a second high-pressure valve, which are installed in the first high-pressure guide tube and the second high-pressure guide tube, respectively;

a first low-pressure valve and a second low-pressure valve, which are installed in the first low-pressure guide tube and the second low-pressure guide tube, respectively; and a first flow valve and a second flow valve, which are installed in the first liquid guide tube and the second liquid guide tube, respectively.

16. The air conditioning apparatus according to claim 15, wherein the first bypass combination point is defined at a point between the first heat exchanger and a first flow valve, and the second bypass combination point is defined at a point between the second heat exchanger and a second flow valve.

17. The air conditioning apparatus according to claim 12, further comprising:

a first refrigerant tube having one end defining a first refrigerant branch point, at which the first high-pressure guide tube and the first low-pressure guide tube are combined with each other, and the other end connected to a refrigerant passage of the first heat exchanger; and a second refrigerant tube having one end defining a second refrigerant branch point, at which the second high-pressure guide tube and the second low-pressure guide tube are combined with each other, and the other end connected to a refrigerant passage of the second heat exchanger.

18. The air conditioning apparatus according to claim 17, further comprising:

a gas refrigerant sensor installed in each of the first refrigerant tube and the second refrigerant tube to detect a temperature of the refrigerant;

a liquid refrigerant sensor installed in each of the first liquid guide tube and the second liquid guide tube to detect a temperature of the refrigerant; and a controller configured to adjust an opening degree of the bypass valve based on the temperatures detected by the gas refrigerant sensor and the liquid refrigerant sensor.

* * * * *